United States Patent [19]

Kinoshita et al.

[11] Patent Number: 5,028,965

[45] Date of Patent: Jul. 2, 1991

[54] COPYING SYSTEM HAVING A SHEET REFEED DEVICE

[75] Inventors: Keichi Kinoshita; Toshio Matsui; Hiroki Yamashita, all of Osaka, Japan

[73] Assignee: Minolta Camera Kabushiki Kaisha, Osaka, Japan

[21] Appl. No.: 410,733

[22] Filed: Sep. 21, 1989

[30] Foreign Application Priority Data

| | | | |
|---|---|---|---|
| Sep. 22, 1988 | [JP] | Japan | 63-238325 |
| Sep. 22, 1988 | [JP] | Japan | 63-238326 |
| Sep. 22, 1988 | [JP] | Japan | 63-238327 |
| Sep. 22, 1988 | [JP] | Japan | 63-238328 |
| Jun. 8, 1989 | [JP] | Japan | 1-146439 |

[51] Int. Cl.[5] ..... G03G 21/00

[52] U.S. Cl. ..... 355/319; 355/308; 355/318; 355/321

[58] Field of Search ..... 355/309, 204, 308, 318, 355/319, 206, 208, 311, 316, 321; 271/7

[56] References Cited

U.S. PATENT DOCUMENTS

| | | | |
|---|---|---|---|
| 3,862,802 | 1/1975 | Till | 355/23 |
| 4,496,142 | 1/1985 | Iwasaki | 271/3 |
| 4,537,497 | 8/1985 | Masuda | 355/313 |
| 4,568,169 | 2/1986 | Wada et al. | 355/319 |
| 4,573,789 | 3/1986 | Wada | 355/319 |
| 4,583,834 | 4/1986 | Seko et al. | 355/206 |
| 4,724,460 | 2/1988 | Shinyashiki | 355/308 |
| 4,745,439 | 5/1988 | Hanada et al. | 355/244 |
| 4,821,070 | 4/1989 | Nakade et al. | 355/206 |
| 4,855,787 | 8/1989 | Hashimoto et al. | 355/319 X |
| 4,905,053 | 2/1990 | Matsuo et al. | 355/319 |

*Primary Examiner*—Arthur T. Grimley
*Assistant Examiner*—Sandra L. Hoffman
*Attorney, Agent, or Firm*—Willian, Brinks, Olds, Hofer, Gilson & Lione

[57] ABSTRACT

A copying system including an image forming device for forming an image on each of the sheets, a sheet refeeding device for successively accommodating the first copied sheets, and successively refeeding same, after the first image forming is finished, to the image forming device, to form a second image thereon, the copying system inputting the number of sheets to be copied, detecting a sheet size, determining the maximum copiable number of sheets corresponding to the detected sheet size, wherein the sheet refeeding device includes a first winding device, a second winding device and a web extended on the first and second winding device, wherein the web is wound around the first winding device while supporting the sheets thereon so as to accommodate the sheets on the first winding device, and wherein the web is unwound from the first winding device and wound around the second winding device so as to feed the sheets for the image forming process.

18 Claims, 30 Drawing Sheets

Fig. 15 (1)
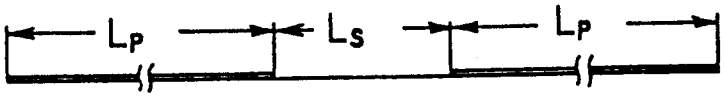
Fig. 15 (2)
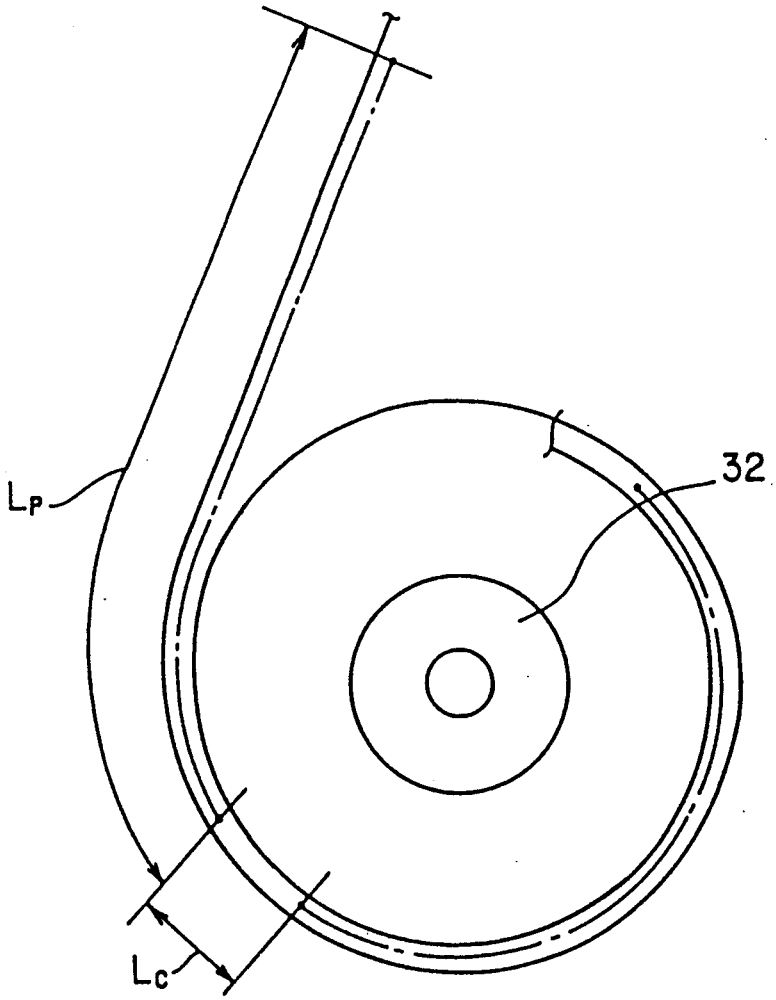

Fig. 15 (3)
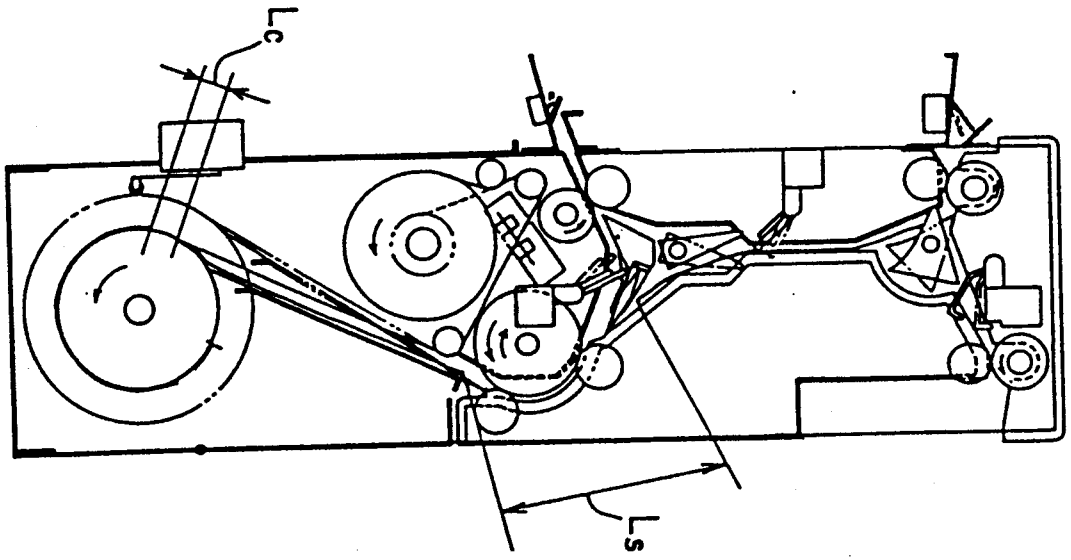

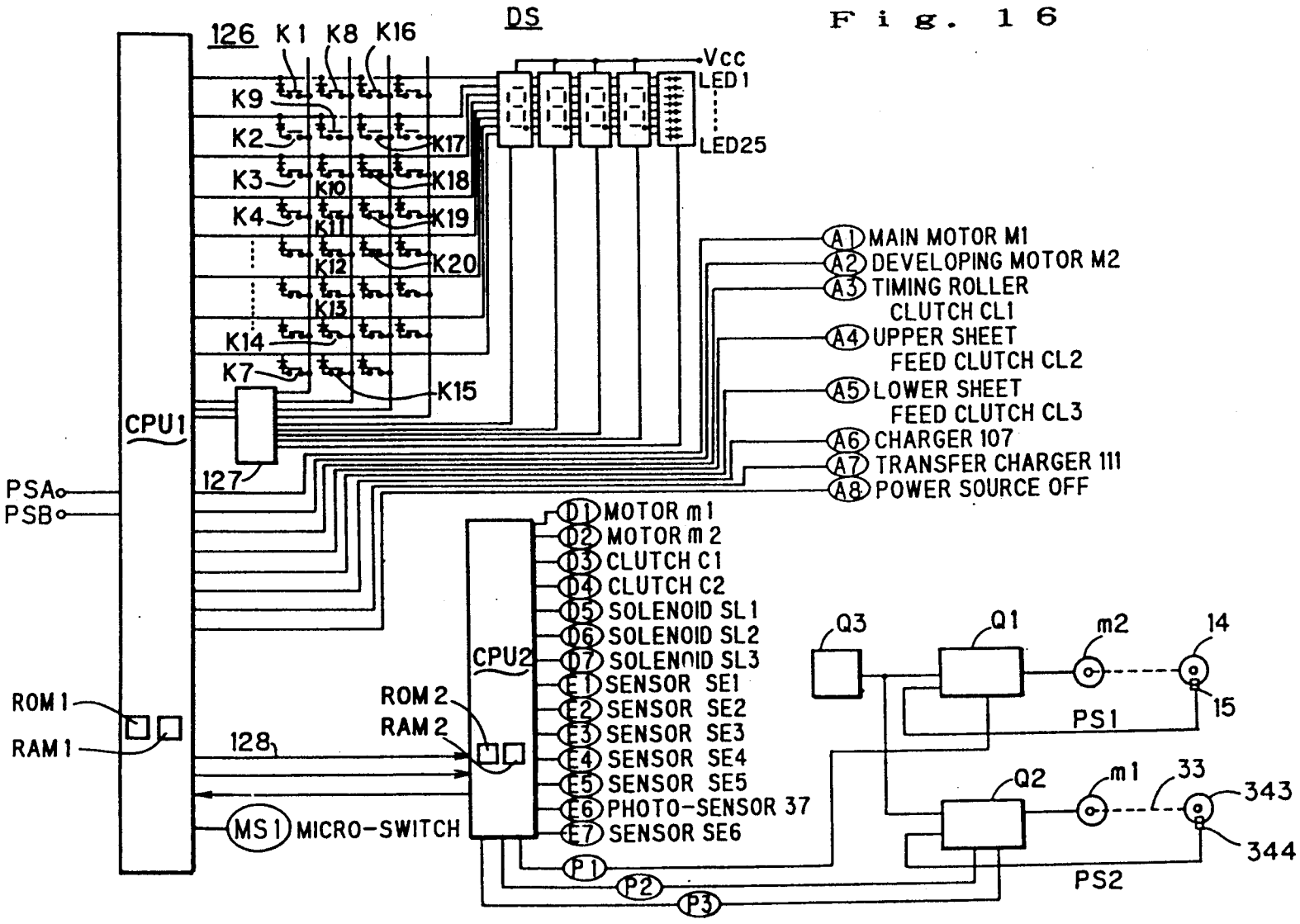
Fig. 16
DS
Vcc
LED1
LED25
126
K1
K8
K16
K9
K2
K3
K4
K7
K14
K15
K17
K18
K19
K20
K10
K11
K12
K13
127
CPU1
PSA
PSB
ROM1
RAM1
128
MICRO-SWITCH
MS1
A1 MAIN MOTOR M1
A2 DEVELOPING MOTOR M2
A3 TIMING ROLLER CLUTCH CL1
A4 UPPER SHEET FEED CLUTCH CL2
A5 LOWER SHEET FEED CLUTCH CL3
A6 CHARGER 107
A7 TRANSFER CHARGER 111
A8 POWER SOURCE OFF
O1 MOTOR m1
O2 MOTOR m2
O3 CLUTCH C1
O4 CLUTCH C2
O5 SOLENOID SL1
O6 SOLENOID SL2
O7 SOLENOID SL3
E1 SENSOR SE1
E2 SENSOR SE2
E3 SENSOR SE3
E4 SENSOR SE4
E5 SENSOR SE5
E6 PHOTO-SENSOR 37
E7 SENSOR SE6
CPU2
ROM2
RAM2
P1
P2
P3
Q1
Q2
Q3
m2
m1
PS1
PS2
14
15
33
343
344

Fig. 24 (1)
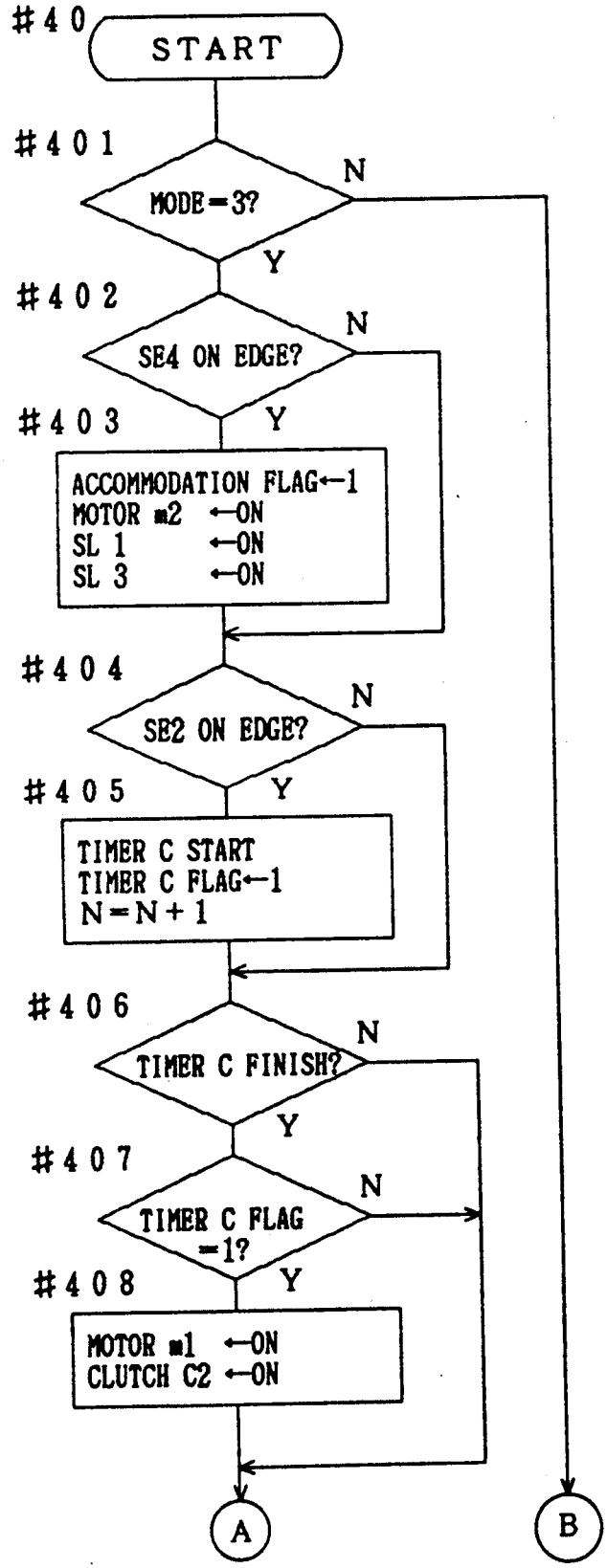

Fig. 24 (2)
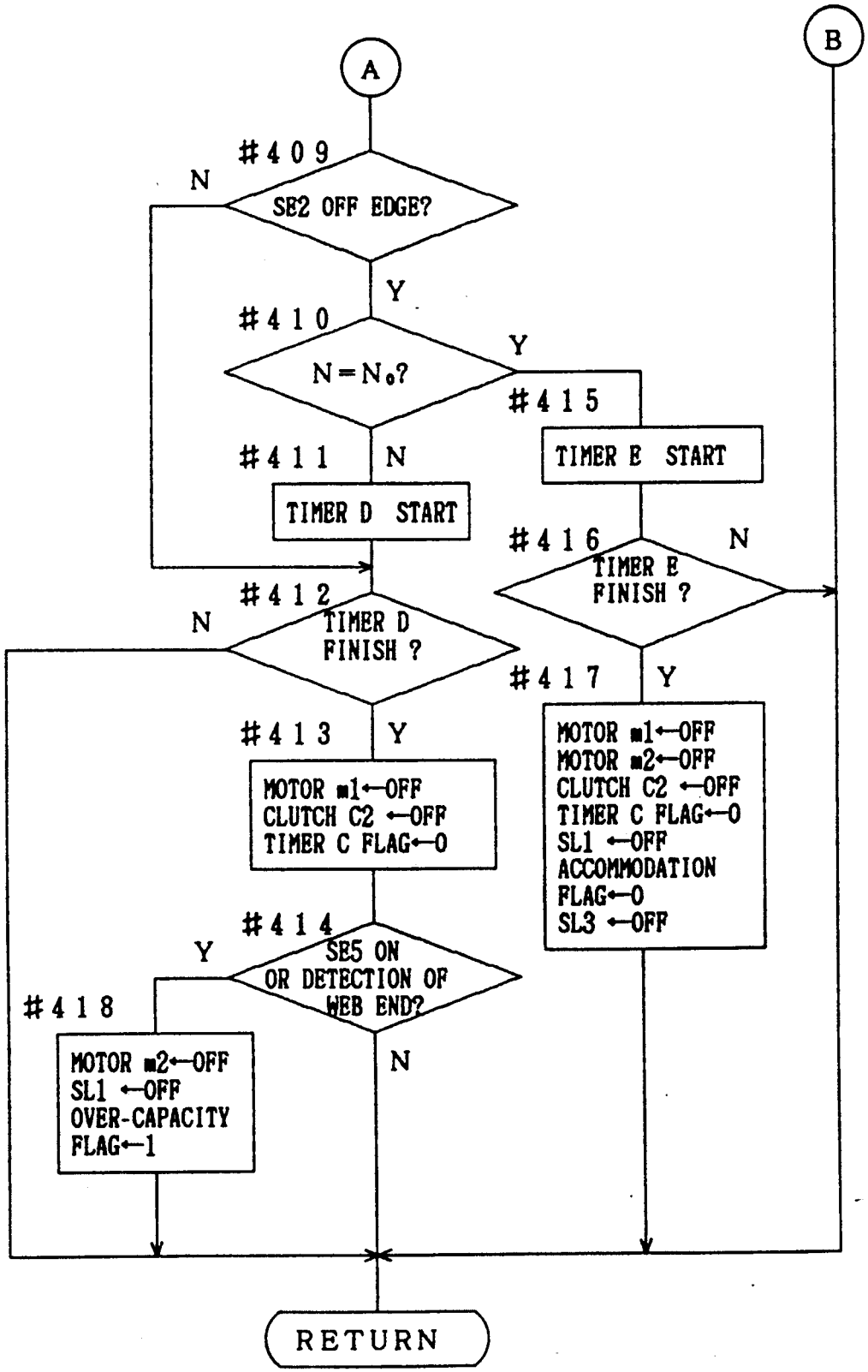

Fig. 25 (1)
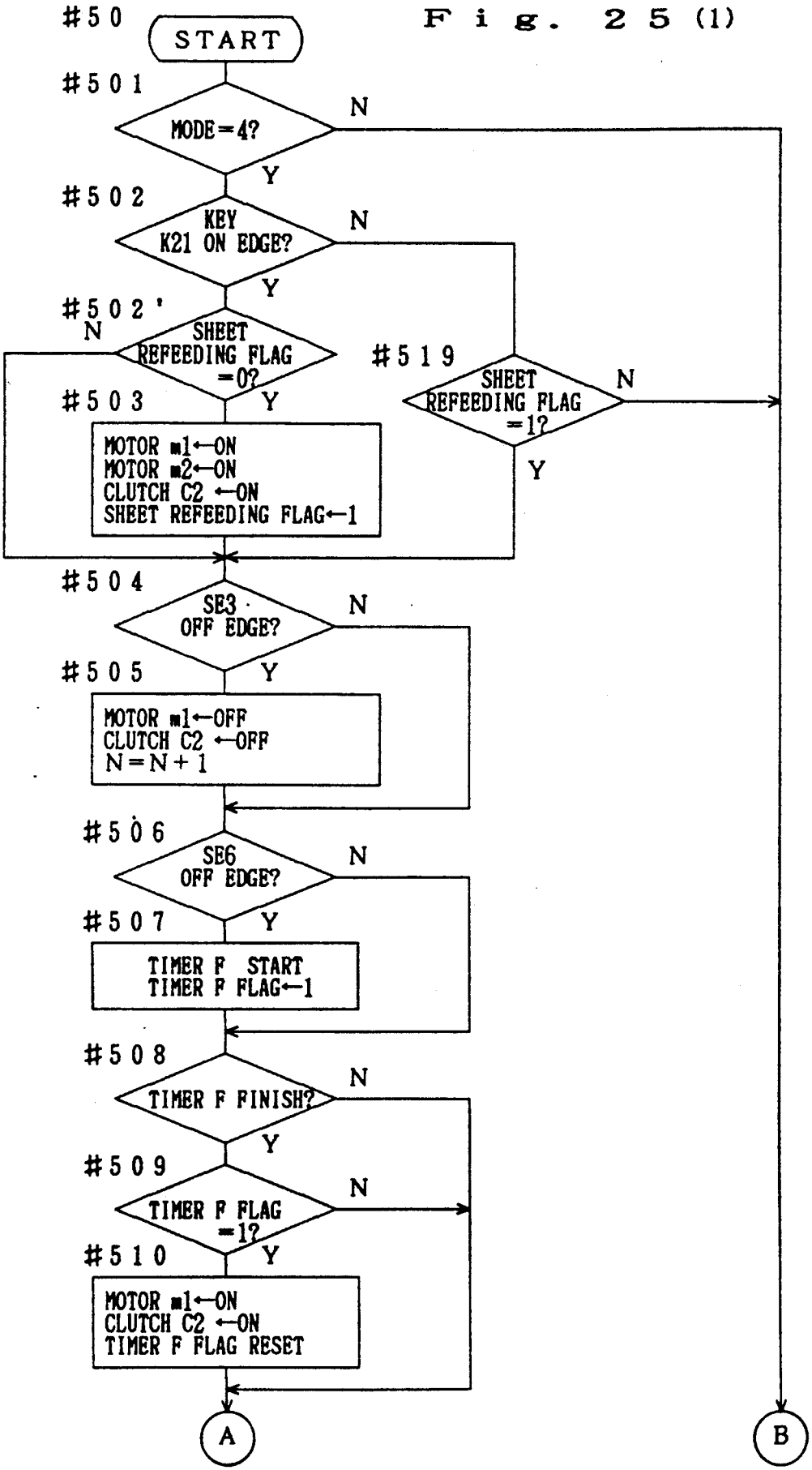

Fig. 25 (2)
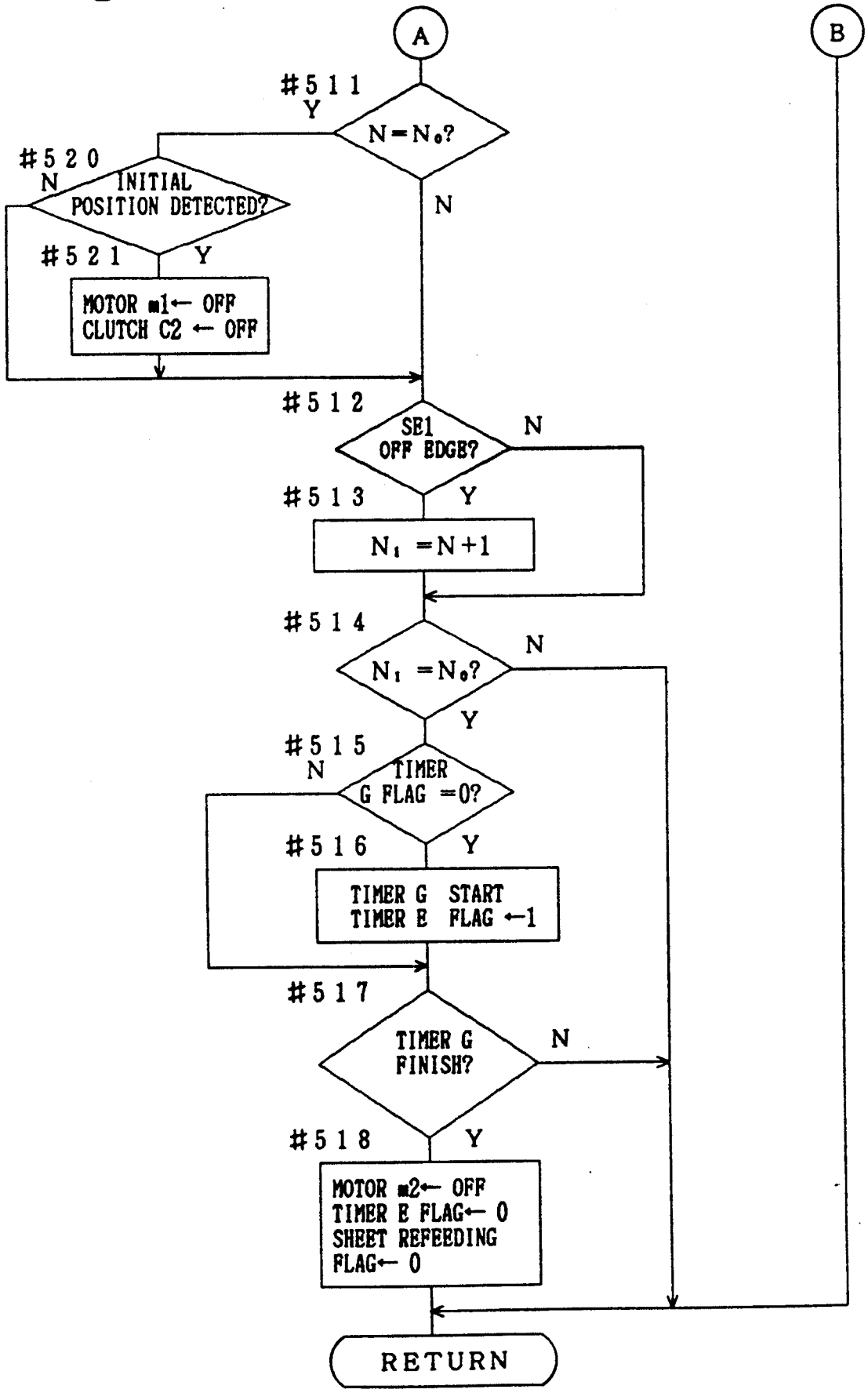

SHEET INTERVAL ARE SHORTENED AT $T_D$

SHEET INTERVALS ARE ENLARGED AT $T_F$.

COPYING SYSTEM HAVING A SHEET REFEED DEVICE

BACKGROUND OF THE INVENTION

The present invention relates generally to a copying system, and more particularly to an apparatus and method for effecting duplex copying (including double-face and composite copying) on one copy sheet.

When a copying apparatus or any other image forming apparatus makes duplex copies on one copy sheet; for example, on both sides of one sheet, it is required to refeed the copy sheets to the image forming section after an image is formed on one side thereof. In order to refeed the copy sheets there have been many proposals; one example is disclosed in U.S. Pat. No. 4,745,439. This prior art teaches that there is provided an intermediate tray for storing the copy sheets each having an image on one side and refeeding them to the image forming section. Another example is disclosed in U.S. Pat. No. 3,862,802 which teaches that there is provided a storage means in the form of a roll-type web extended between two winders wherein the sheets are supported between adjacent layers of the web. When the web is wound around a first winder from a second winder, the sheets are delivered to an image forming section.

However, in the first-mentioned apparatus having an intermediate tray there is a need for providing a device for sorting or separating the sheets from each other, so as to feed them sheet by sheet smoothly. In the second-mentioned apparatus there is no need for providing such a sorting or separating expedient but the problem is that it is difficult to remove a jamming of the copy sheets because of the fact that the sheet refeeding apparatus is positioned at a higher place than the image forming section. Another disadvantage is that the image forming apparatus as a whole becomes large in size.

SUMMARY OF THE INVENTION

Accordingly, an object of the present invention is to provide a copying system which dispenses with the necessity of providing any device for separating the sheets from each other in refeeding the copy sheets.

Another object of the invention is to provide a copying system capable of removing a jamming of copy sheets easily.

A further object of the present invention is to provide a copying system having a sheet refeeding device of such a compact structure as to be readily attached or detached as desired.

According to one aspect of the present invention, there is provided a copying apparatus comprising an input means for inputting the number of sheets to be copied, a copying means for forming an image on each of the sheets fed in succession, a sheet refeeding means for successively accommodating the first copied sheets, and refeeding same in succession to the image forming means, after the first image forming is finished, to form a second image thereon, means for detecting a sheet size, and means for determining the maximum copiable number of sheets corresponding to the detected sheet size.

Preferably, the copying apparatus includes a control means for stopping the copying operation when the number of copied sheets reaches the determined maximum number.

The first image can be formed on a first side of each sheet, and the second image can be formed on a second side thereof, or alternatively, the first and second images can be on the same side of each sheet. The first-mentioned case is a double-face copy and the second-mentioned case is a composite copy.

The sheet refeeding means can include a first winding shaft, a second winding shaft and a web fixed to the first and second winding shafts at each end thereof, wherein the web is wound around the first winding shaft with the sheets placed thereon so as to accommodate the sheets on the first winding shaft, and wherein the web is unwound from the first winding shaft and wound around the second winding shaft so as to feed the sheets on the web to the image forming means. When the length of the web is predetermined, the number of sheets to be accommodated on the first winding shaft differs depending on the sheet sizes.

It is also possible that the sheet refeeding means includes a first means for feeding the copied sheets to the web so as to secure a smooth feeding thereof, and a first means for driving the first feeding means and the web at a speed satisfying the relation ($V1 < V2$), where V1 is a speed of feeding the sheets by the first feeding means and V2 is a speed of winding the web around the first winding shaft, a second means for feeding the copied sheets from the web to the image forming means, and a second means for driving the second feeding means and the web at a speed satisfying the relation ($V3 > V4$), where V3 is a speed of feeding the sheets by the second feeding means and V4 is a speed of unwinding the web from the first winding shaft.

According to another aspect of the present invention, there is provided a copying apparatus which includes means for successively forming a first original document image on each of a desired number of sheets, an intermediate accommodating means for successively accommodating the first copied sheets, means for refeeding the first copied sheets from the intermediate accommodating means to the image forming means, after the first image forming is finished, so as to form a second original document image thereon, the image forming apparatus further including an input means for inputting the number of sheets to be copied, means for detecting a sheet size, means for determining the maximum copiable number of sheets corresponding to the detected sheet size; and a control means for stopping the copying operation when the number of copied sheets reaches the determined maximum number.

The first image can be formed on a first side of each sheet, and the second image can be formed on a second side thereof, or alternatively, the first and second image can be on the same side of each sheet. The first-mentioned case is a double-face copy and the second-mentioned case is a composite copy.

According to a further aspect of the present invention, there is provided a method for controlling a copying apparatus which includes the steps of successively forming a first image on each of a desired number of sheets, of successively accommodating the first copied sheets in an intermediate accommodating means, of refeeding the first copied sheets from the intermediate accommodating means to the image forming means so as to form a second image thereon, the image forming method further comprising the steps of inputting the number of sheets to be copied for the image forming process, detecting a sheet size, determining the maximum copiable number of sheets corresponding to the detected sheet size, and controlling to stop the copying operation when the number of copied sheets reaches the determined maximum number.

According to a still further aspect of the present invention, there is provided a copying apparatus including a main framework structure having a first port and a second port, an image forming means disposed in the main framework structure to form an image on a sheet, a discharging means disposed in the main framework structure to discharge sheets having an image formed thereon by the image forming means through the first port out of the main framework structure, a sheet receiving means disposed in the main framework structure for feeding sheets received from outside the main framework structure through the second port to the image forming means, a sub-framework structure detachable to the main framework structure, having a third port located opposite to the first port of the main framework structure, and a fourth port located opposite to the second port thereof, a sheet refeeding means disposed in the sub-framework structure, comprising a first winding means, a second winding means, a web extended on the first and second winding means, a first feeding means for feeding the sheets received at the third port to the web, a second feeding means for feeding the sheets from the web to the fourth port, wherein the sheets fed by the first feeding means are placed on the web, the web being wound around the first winding means with the sheets thereon so as to accommodate the sheets on the first winding means, and wherein the web wound around the first winding means is unwound therefrom onto the second winding means so as to feed the sheets on the web through the fourth port into the second port.

In order to prevent the sheets from becoming loosened and damaged owing to the loosening, it is preferred that the speed U1 of the discharging means, the sheet feeding speed V1 of the first feeding means and the speed V2 at which the web is wound around the first winding means, the speed U2 at which the sheet receiving means receives the sheets, the sheet feeding speed V3 of the second feeding means and the speed V4 at which the web is wound around the second winding means should satisfy the following relations:

$$U1<V1<V2 \quad (1)$$

$$V4<V3<U2 \quad (2)$$

Preferably, the first and the second ports are both provided in one side of the main framework structure with the first port being located above the second port. As a result, it becomes easy to remove a jamming occurring in the sub-framework structure, and the sub-framework structure and the sheet refeeding device can be compact in size to be readily attached to or detached from the main framework structure as an optional unit.

When the sheet refeeding means includes the first and the second winding means and the web extended thereon, wherein the web is wound around the first winding means with the sheets placed thereon so as to accommodate the sheets on the first winding means, and the web is unwound from the first winding means and wound around the second winding means so as to feed the sheets on the web to the image forming means, it is possible that means for detecting any abnormality occurring in winding the web around the first winding means, and a control means for stopping the image forming operation in response to the detection of abnormality are additionally provided.

Other objects and advantages of the present invention will become more apparent from the following detailed description, when taken in conjunction with the accompanying drawings which show, for the purpose of illustration only, one embodiment in accordance with the present invention.

BRIEF DESCRIPTION OF THE DRAWINGS

FIG. 15(1) is a view showing an interval between one sheet and the next in the copying apparatus;

FIG. 15(2) is a schematic view showing an interval between one sheet and the next in the sheet refeeding device;

FIG. 15(3) is a schematic view exemplifying a state where the sheet is being accommodated in the sheet holding section;

FIG. 16 is a diagram showing a control system including a micro-computer for controlling the copying apparatus;

FIGS. 24(1) and 24(2) are flowcharts showing a routine for executing the mode (3);

FIGS. 25(1) and 25(2) are flowcharts showing a routine for executing the mode (4);

DETAILED DESCRIPTION OF THE PREFERRED EMBODIMENTS

Figure 1:
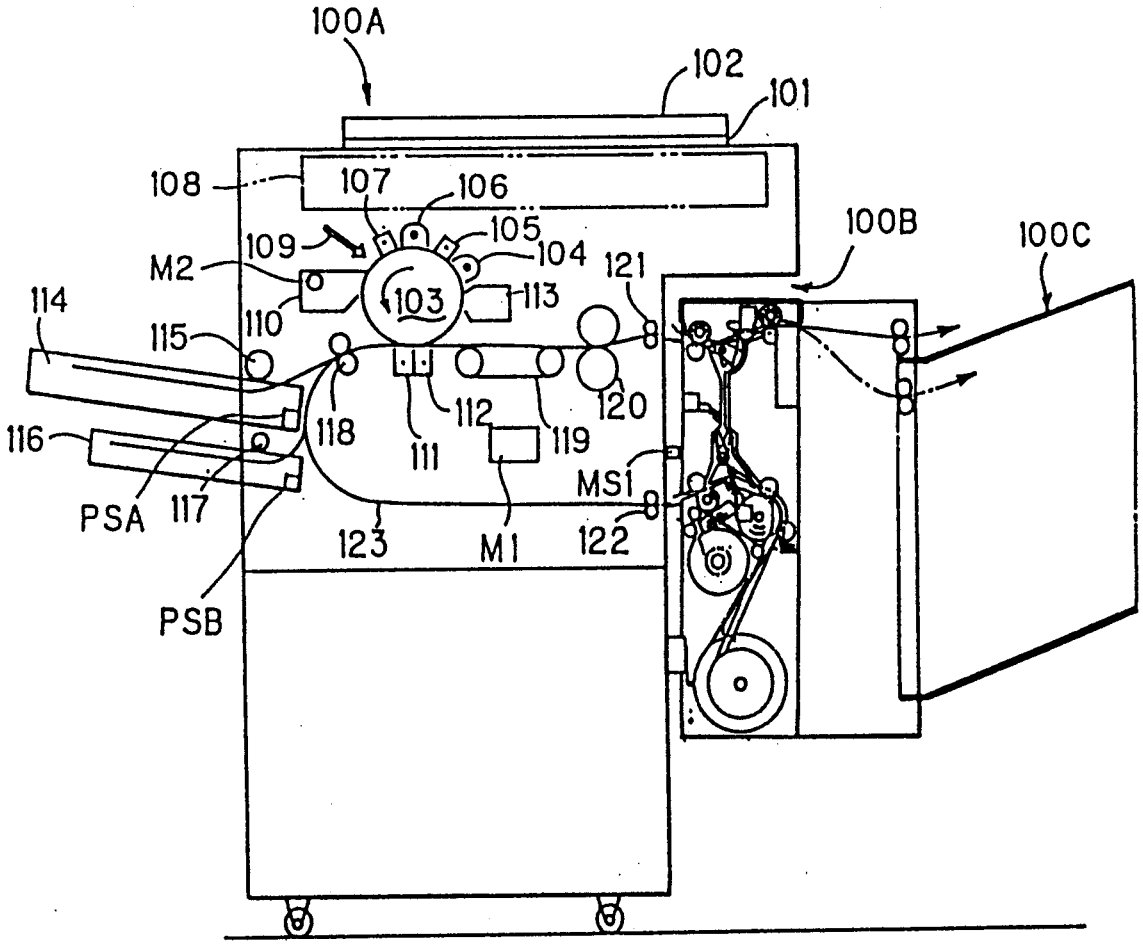
FIG. 1 is a schematic cross-sectional side view showing a copying apparatus, including a copy sheet refeeding device, according to one embodiment of the present invention.

Referring to FIG. 1, a copying apparatus 100A is equipped with a sheet refeeding device 100B, and includes a copying mechanism known in the art.

More specifically, an original document is placed on a glass panel 101 covered by a cover 102 capable of opening and closing. The copying apparatus 100A houses a photosensitive drum 103 which is rotatable in a counter-clockwise direction. Disposed around the photosensitive drum 103 are a main eraser lamp 104, a subcharger 105, a suberaser lamp 106, a main charger 107, a developing unit 110, a transfer charger 111, a sheet separating charger 112, and a cleaning device 113.

The photosensitive drum 103 is uniformly sensitized while it passes by the eraser lamps 104, 106 and the chargers 105, 107. The drum surface is exposed to a light 109 emitted by an optical scanning system 108 and an electrostatic latent image of the original document is formed on the drum 103. The photosensitive drum 103 and the other moving members mentioned above are driven by a motor $M_2$ used for developing.

The optical scanning system 108 of a known structure is disposed below the glass panel 101, and scans the image of the original document. The position is indicated by dotted lines in FIG. 1.

Sheets are stored in an upper cassette 114 and a lower cassette 116; in the illustrated embodiment the upper cassette 114 stores A-4 size papers laterally placed and the lower cassette 116 stores B-5 size papers laterally placed, wherein "lateral" means a direction perpendicular to the feed of the sheets. Size sensors PSA and PSB are provided at sheet entry ports provided on the copying apparatus to detect codes accorded to the cassettes 114 and 116. The sheets in the cassette 114 are fed into the copying apparatus 100A by rollers 115, and those in the cassette 116 are fed thereto by rollers 117. Then the sheets are guided to timing rollers 118, and after stopping at the rollers 118 for a while, they are fed to a transfer section synchronuously with the toner image formed on the photosensitive drum 103. A toner image is transferred onto the sheets by the transfer charger 111, and the sheets having the toner images are separated from the surface of the drum 103 by the sheet separating charger 112. The sheet bearing the toner image is passed through image-fixing rollers 120 by a belt 119 so that the image is fixed, and transported to the sheet refeeding device 100B by discharge rollers 121, which will be hereinafter described in greater detail. Every time the toner image is transferred onto the sheet, the charges remaining on the photosensitive drum 103 are erased by the eraser 104, and the residual toner thereon is removed by the cleaning device 113. In this way the photosensitive drum 103 becomes prepared for the subsequent process.

The main motor $M_1$ drives the sheet feed rollers 115, 117, the timing rollers 118, the conveyor belt 119, the image-fixing rollers 120 and the discharge rollers 121. In addition, the main motor $M_1$ drives delivery rollers 122 for sending sheets for double-face or composite copying and a sheet feeding device (not shown) for feeding the sheets from the sheet refeeding device 100B to the timing rollers 118 along a path 123. The timing rollers 118, the feed rollers 115 and the feed rollers 117 are respectively driven by the main motor $M_1$ through a clutch CL1, a clutch CL2 and a clutch CL3.

Figure 2:
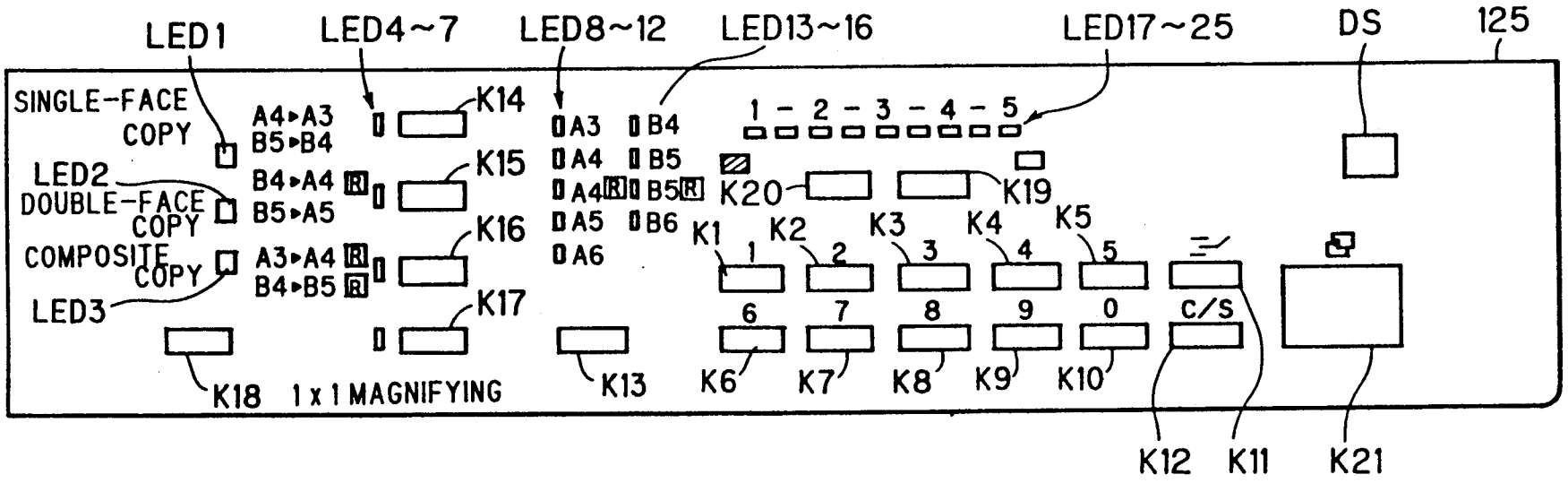
FIG. 2 is a plan view showing an operation panel of the copying apparatus.

FIG. 2 shows an operation panel 125, which has the following operation keys and switches:

K21. . . A press button switch for starting a copying operation.

DS. . . A seven-segment display for indicating the number of sheets to be copied and the conditions of the copying apparatus.

K1 to K10. . . Ten keys for determining the number of sheets to be copied.

K11. . . An interrupt key

K12. . . A clear/stop key for clearing the set number of sheets or stopping the copying operation.

K13. . . A selection key for selecting the cassette according to the desired sheet size.

LEDs 8 to 16. . . Light-emitting diodes for indicating the kind of the sheet stored in the selected cassette.

K14 to K17. . . Keys for setting the copying magnification.

LEDs 4 to 7. . . Light-emitting diodes for indicating the copying magnification.

K18. . . A key for selecting the single-face, the double-face or the composite copy mode.

LEDs 1 to 3 . . . Light-emitting diodes for indicating the copy mode selected by the key 18.

K19 and K20 . . . Up and down keys for varying copy image density.

LEDs 17 to 25 . . . Light-emitting diodes for indicating the copy image density.

The inputs of these keys on the operation panel 125 are given to the terminals of a micro-computer CPU1 which is used to control the operation of the copying apparatus.

The sheet refeeding device 100B will be described:

The device 100B is detachably attached to the copying apparatus 100A by means of screws or the like (not shown). The copying apparatus 100A is provided with a micro-switch MS1 which detects the attachment of the sheet refeeding device 100B. A sorter 100C is hinged to the sheet refeeding device 100B.

Figure 3:
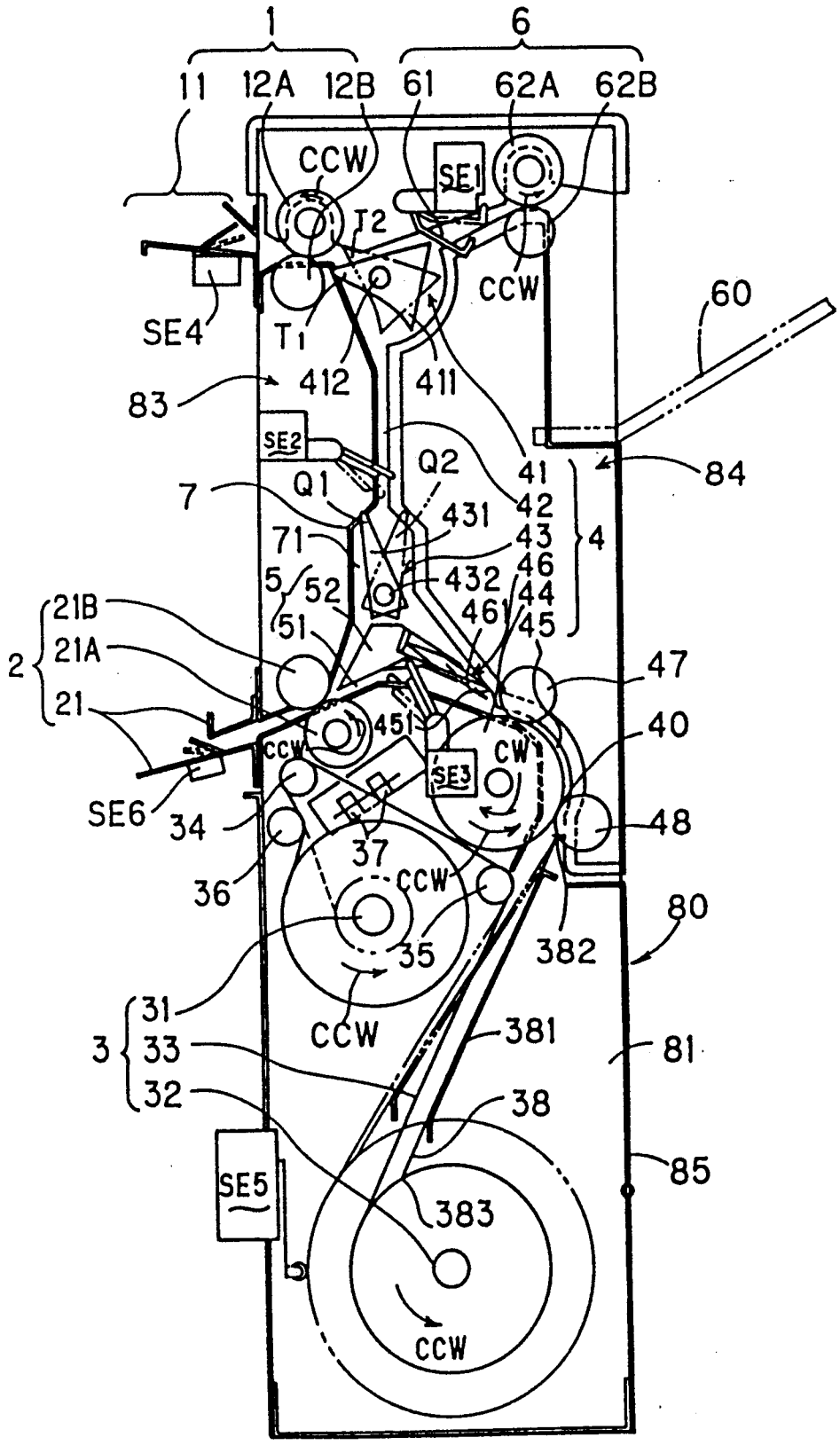
FIG. 3 is a schematic cross-sectional view showing the sheet refeeding device of FIG. 1.

Referring to FIG. 3 the sheet refeeding device 100B includes a sheet receiving section 1 located opposite to the discharge rollers 121 of the copying apparatus 100A, and a sheet delivering section 2 located opposite to the delivery rollers 122 of the copying apparatus 100A.

The sheet receiving section 1 includes a guide 11 for receiving the sheets from the copying apparatus 100A, a pair of rollers 12A and 12B for sending the sheets on the guide 11 backward. Each roller 12A and 12B includes a rotary shaft and disc members concentrically fixed thereto. The shaft of the roller 12A is driven in a counter-clockwise direction (hereinafter called "CCW"). The guide 11 is provided with a sensor SE4 for detecting the passage of sheets, which will be described below.

The sheet delivering section 2 includes a second guide 21 for transporting the sheets to the copying apparatus 100A, and a pair of rollers 21A and 21B for feeding the sheets onto the second guide 21. Each of the rollers 21A and 21B includes a rotary shaft and disc members concentrically fixed thereto. The shaft of the roller 21A is driven in the CCW direction. The second guide 21 is provided with a sensor SE6 for detecting the passage of sheets.

Figure 4:
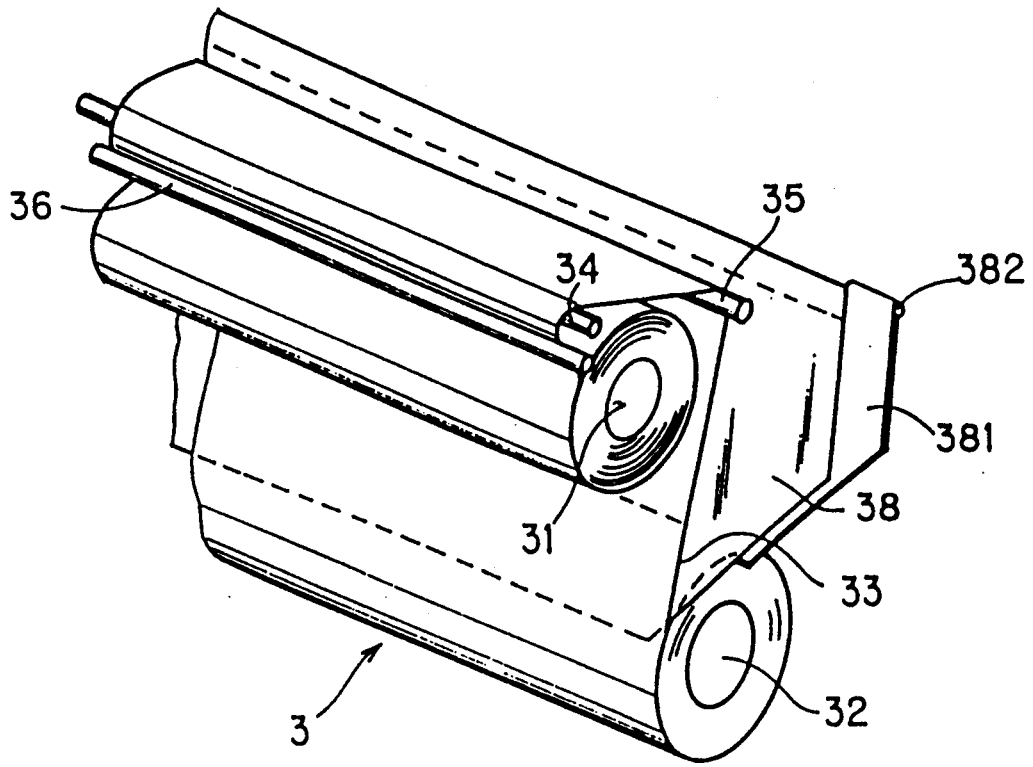
FIG. 4A is a perspective view showing a part of a sheet holding device.
FIG. 4B is a schematic view showing a web used in the sheet holding device of FIG. 4A.
Figure 4:
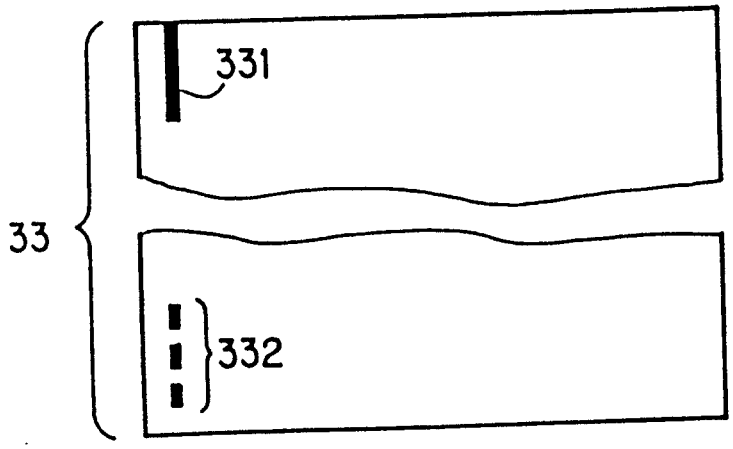
Figure 5:
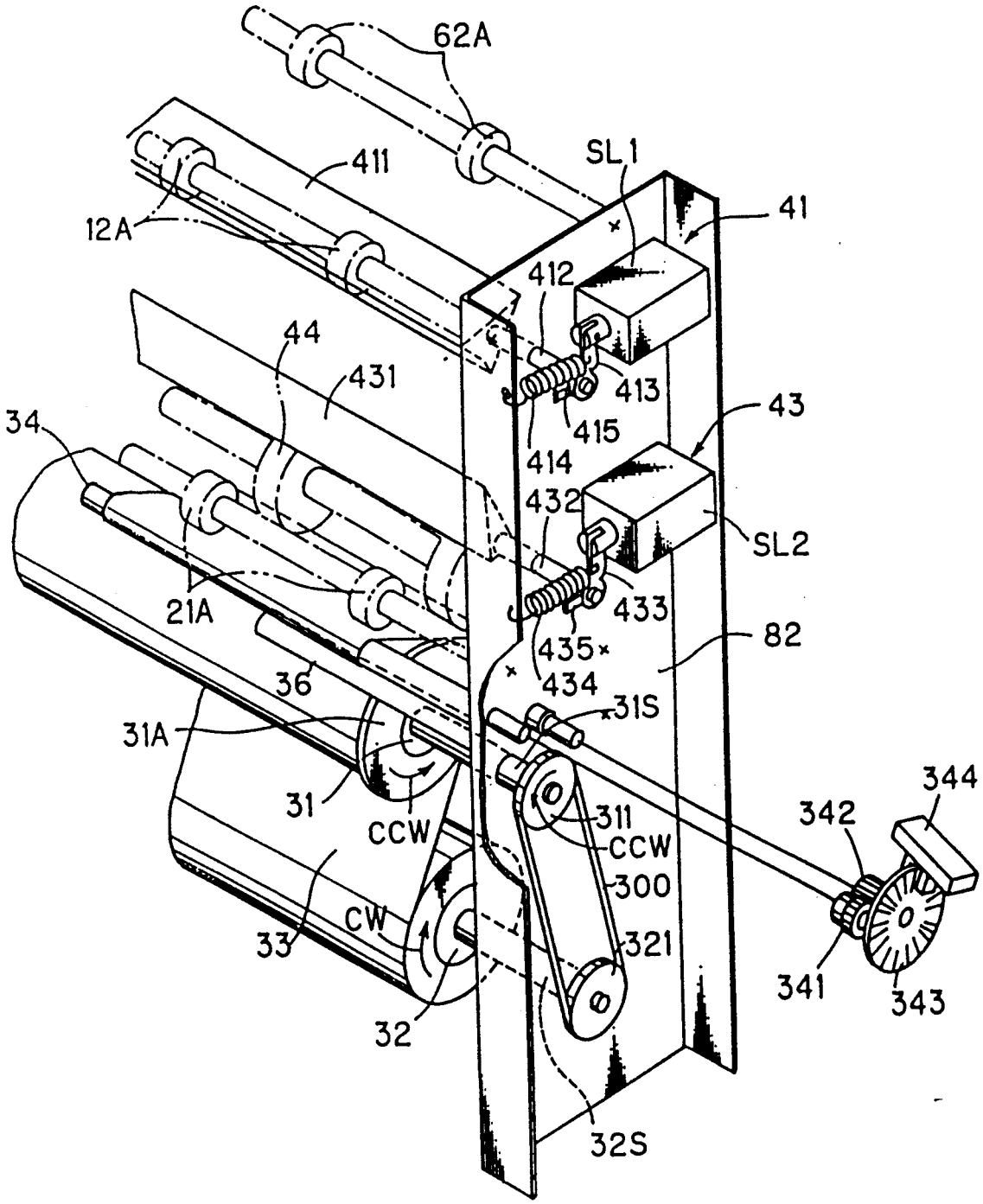
FIG. 5 is a perspective view showing a portion of the sheet refeeding device of FIG. 1 when viewed from the side of the copying section.

There is provided a sheet holding section 3 under the sheet delivering section 2. The sheet holding section 3 includes an upper winding shaft 31 and a lower winding shaft 32, between which a web 33 is extended through idle rollers 34 and 35. The reference numeral 36 denotes a tension roller which stretches the web 33 under the idle roller 34. The web 33 is made of resilient polyester sheet. The upper winding shaft 31 is provided with flanges 31A at both ends as shown in FIG. 5. The web 33 runs from the winding shaft 32 and is wound around the shaft 31 when the shaft 31 is driven in the CCW direction, and runs from the shaft 31 and is wound around the shaft 32 when the shaft 32 is driven in the CCW direction. There is provided a sensor 37 (e.g. a photo-sensor) between the idle rollers 34 and 35. As shown in FIG. 4B the web 33 is provided with marks 331 and 332 adapted to cut off the light from the photo-sensor 37. The mark 331 indicates the start of winding the web 33 around the shaft 31, and the other mark 332 indicates the termination of it. The two marks 331 and 332 have different patterns so as to distinguish between the start and the termination of the winding operation. When the sheet refeeding device 100B is at an initial stage of operation, the web 33 is wound around the shaft 31 until the sensor 37 detects the end thereof. The sheet holding section 3 is provided with a scraper 38 which is lined with a rigid scraper guide 381 as shown in FIGS. 3 and 4A. The scraper guide 381 is rotatably supported on a shaft 382 which is located behind and above the idle roller 35. In this way the lower end 383 of the scraper 38 keeps contact with the web 33 on the shaft 32 by gravity. The left and right edges of the scraper 38 are inwardly cut at the lower end portion so as not to project beyond the end faces of the winding shaft 32 as shown in FIG. 4A. This arrangement prevents the sheet on the winding shaft 32 from being caught by the scraper 38 when the sheet is unwound from the winding shaft 32.

The sheet refeeding device 100B includes a sheet introducing section 4 for feeding the sheets from the receiving section 1 to the sheet holding section 3, and a sheet sending-out section 5 for feeding the sheets from the sheet holding section 3 to the delivering section 2.

The sheet introducing section 4 includes a first change-over device 41 disposed behind the rollers 12A, 12B of the receiving section 1, a path 42 extending downward from the change-over device 41, and a second change-over device 43 facing the lower end of the path 42, a roller 44, a path 45 extending from the second change-over device 43 along the roller 44, and a third change-over device 46 disposed at a middle point of the path 45. The roller 44 includes a rotary shaft and disc members concentrically fixed thereto.

The reference numerals 47 and 48 denote an upper pinch roller and a lower pinch roller, respectively, which keep contact with the roller 44. Each roller 47 and 48 includes a rotary shaft and disc members concentrically fixed thereto. The nip 40 between the lower pinch roller 48 and the roller 44 is faced to an entrance of a sheet feed path provided by the web 33 and the scraper 38. The roller 44 is rotated in a clockwise direction (hereinafter called "CW") when the sheet is fed to the sheet holding section 3. Whereas, when the sheet is fed therefrom, it is rotated in the CCW direction. There is provided a sensor SE2 in a lower end of a path 42 to detect the passage of the sheets.

The sheet sending-out section 5 includes the roller 44, and a path 51 extending from the nip between the roller 44 and the upper pinch roller 47 up to the delivering section 2. The path 51 is formed under change-over members 461 and a change-over guide 52 supporting the change-over members 461. The change-over guide 52 is disposed at a constant position below a change-over member 431 of the change-over device 43. A sensor SE3 is faced to the path 51 to detect the passage of the sheets.

There is provided a path 61 behind the change-over device 41 for the sheet introducing section 4. The discharge rollers 62A and 62B are located at an end of the path 61. Each of the rollers 62A and 62B includes a rotary shaft and disc members concentrically fixed thereto. The rotary shaft of the roller 62A is driven in the CCW direction. The change-over device 41, the path 61 and the discharge rollers 62A, 62B constitute a sheet discharge section 6. A sensor SE1 is faced to the path 61 to detect the passage of the sheets. When the sorter 100C is not equipped, a tray 60 can be detachably provided below the discharge rollers 62A and 62B.

There is provided a path 71 extending to the rollers 21A and 21B in the opposite side (toward the copying apparatus 100A) to the path 45 bordered by the change-over member 431 of the sheet introducing section 4, and the path 71 constitutes a composite return path 7 together with the change-over device 41 and the path 42 extending downward from the change-over device 41.

All the rollers except for the rollers 47, 48 and 62B, and the winding shafts 31 and 32 are rotatably supported on opposite side plates of the framework 80 of the sheet refeeding device 100B. In FIGS. 1 and 3 the near side plate 82 is omitted to show the internal structure against the far side plate 81. In FIG. 5 the far side plate 81 is omitted, and the near side plate 82 is illustrated.

Referring to FIGS. 3 and 5 the change-over device 41 is provided with a guide bar 411 having a triangular cross-section secured to a shaft 412 which is rotatably supported by the side plates 81 and 82. As best shown in FIG. 5, the shaft 412 projecting through the side plate 82 is provided with an arm 413 at its projecting end. The arm 413 is pulled toward the copying apparatus 100A (leftward in FIG. 5) by a spring 414 until it comes into abutment with a stopper 415. The arm 413 is connected to a solenoid SL1 at its upper end. When the solenoid SL1 is deenergized, the guide bar 411 takes the position T1 indicated by a full line in FIG. 3 under the action of the spring 414. A sheet is fed along the path 61 and discharged out of the sheet refeeding device 100B. When the solenoid SL1 is energized, the guide bar 411 takes the position T2 indicated by dotted lines in FIG. 3 against the spring 414. A sheet is guided downward along the path 42.

Again, referring to FIGS. 3 and 5 the change-over device 43 is provided with a guide bar 431 having a triangular cross-section secured to a shaft 432 which is rotatably supported by the side plates 81 and 82. As best shown in FIG. 5, the shaft 432 projecting through the side plate 82 is provided with an arm 433 at its projecting end. The arm 433 is pulled toward the copying apparatus 100A (leftward in FIG. 5) by a spring 434 until it comes into abutment with a stopper 435. The arm 433 is connected to a solenoid SL2 at its upper end. When the solenoid SL2 is deenergized, the guide bar 431 takes the position Q1 indicated by full line in FIG. 3 under the action of the spring 434. A sheet fed along the path 42 is led to the path 45. When the solenoid SL2 is energized, the guide bar 431 takes the position Q2 indicated by dotted lines in FIG. 3 against the spring 434. The sheet is led to the rollers 21A and 21B of the delivering section 2 along the path 71.

Figure 6:
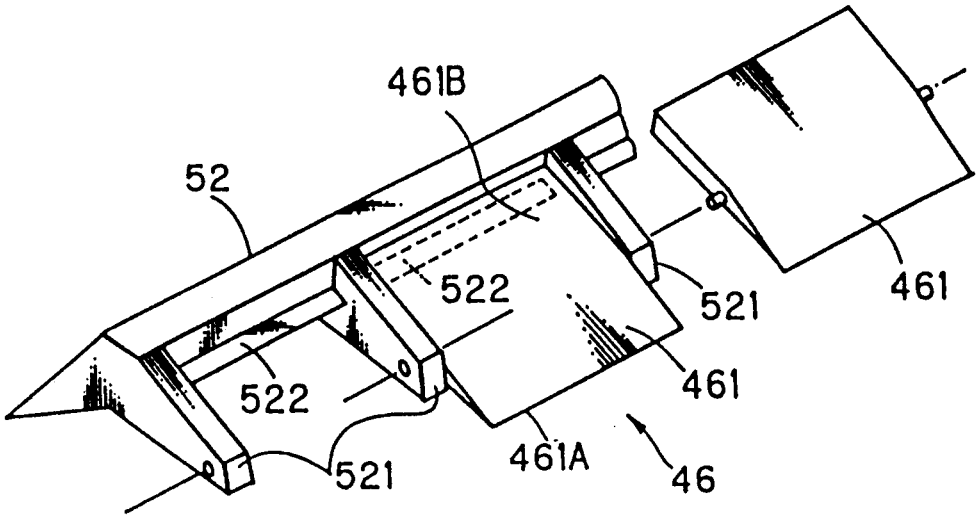
FIG. 6 is an exploded perspective view showing a part of a change-over device.

As described above, the change-over device 46 includes the change-over members 461 which are rotatably supported by the change-over guide 52 disposed below the change-over member 431. As shown in FIG. 6 each change-over member 461 is rotatably supported by arms 521 of the guide 52 at its middle portion so that it rotates until its rearward end 461B comes into abutment with a stopper 522 by gravity and its forward end 461A comes into abutment with a stop 451 (FIG. 3) of the path 45. A sheet fed into the path 45 advances toward the roller 44 while it urges the forward ends 461A of the members 461 to rotate in a clockwise direction against the weight of the rearward ends 461B thereof.

In contrast, a sheet rising from the sheet holding section 3 through the roller 44 is guided by an undersurface of the change-over members 461 into the path 51, wherein the members 461 rise until their forward ends 461A come into abutment with the stop 451.

Figure 7:
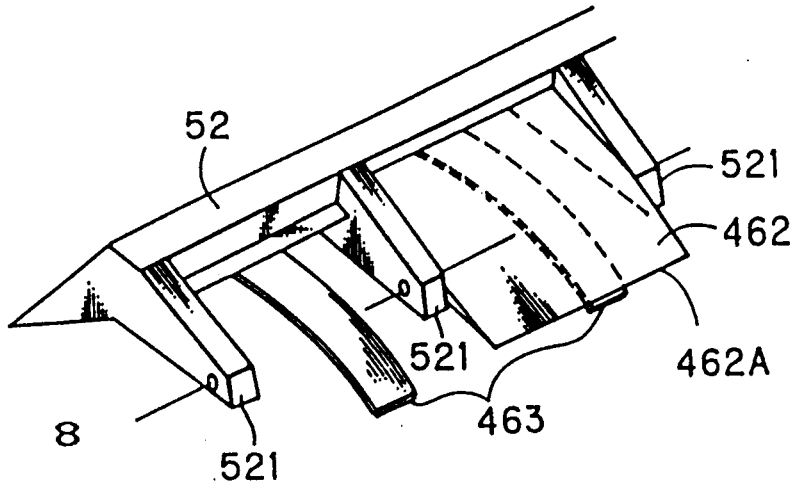
FIG. 7 is a perspective view showing a part of a modified change-over device.
Figure 8:
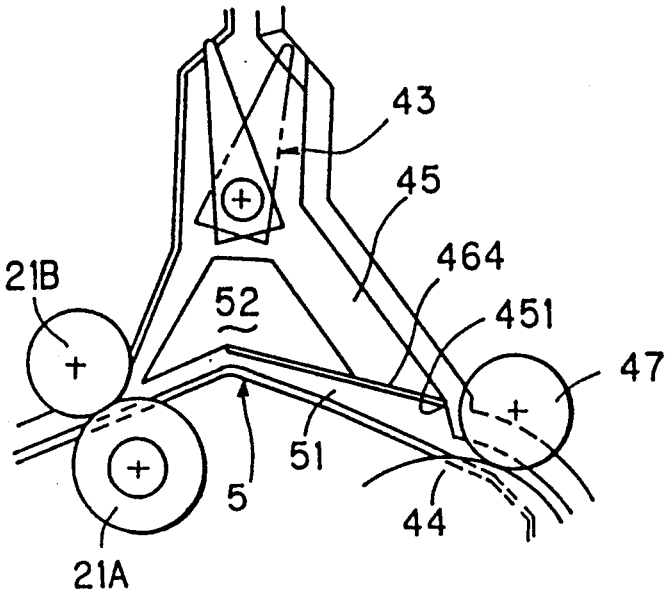
FIG. 8 is a perspective view showing a part of a further modified change-over device.

The change-over device 46 can be constructed as shown in FIGS. 7 or 8. In FIG. 7 the device 46 has plate members 462. Each forward end 462A thereof is raised by a leaf spring 463 secured to the guide 52 with an adhesive or by screws. In FIG. 8 the change-over device 46 includes a resilient film 464 whose rearward end portion is secured to the guide 52 with the forward end portion being projected into the path 45 until it comes into engagement with a stop 451 thereof.

The sensors SE4, SE1, SE2 and SE3 are all mechanical switches, and have actuators which retractably project into the receiving section 1, the path 61, the path 42 and the path 51, respectively.

A sensor SE5 is disposed adjacent to the shaft 32 to detect any abnormality (FIG. 3), such as an extraordinary increase in the diameter of the rolled web 33 on the winding shaft 32 owing to an added layer of the sheets. This sensor SE5 is also a mechanical switch having an actuator facing the winding shaft 32.

If the copying apparatus 100A is provided with a sensor for detecting the discharge of sheets, it can substitute for the sensor SE4 of the sheet receiving section 1. The rollers 21A and 21B of the delivering section 2 are to stop the movement of sheets temporarily so as to correct skewing but instead of them this function can be performed by the rollers 122 (FIG. 1) disposed on the copying apparatus 100A.

Figure 9:
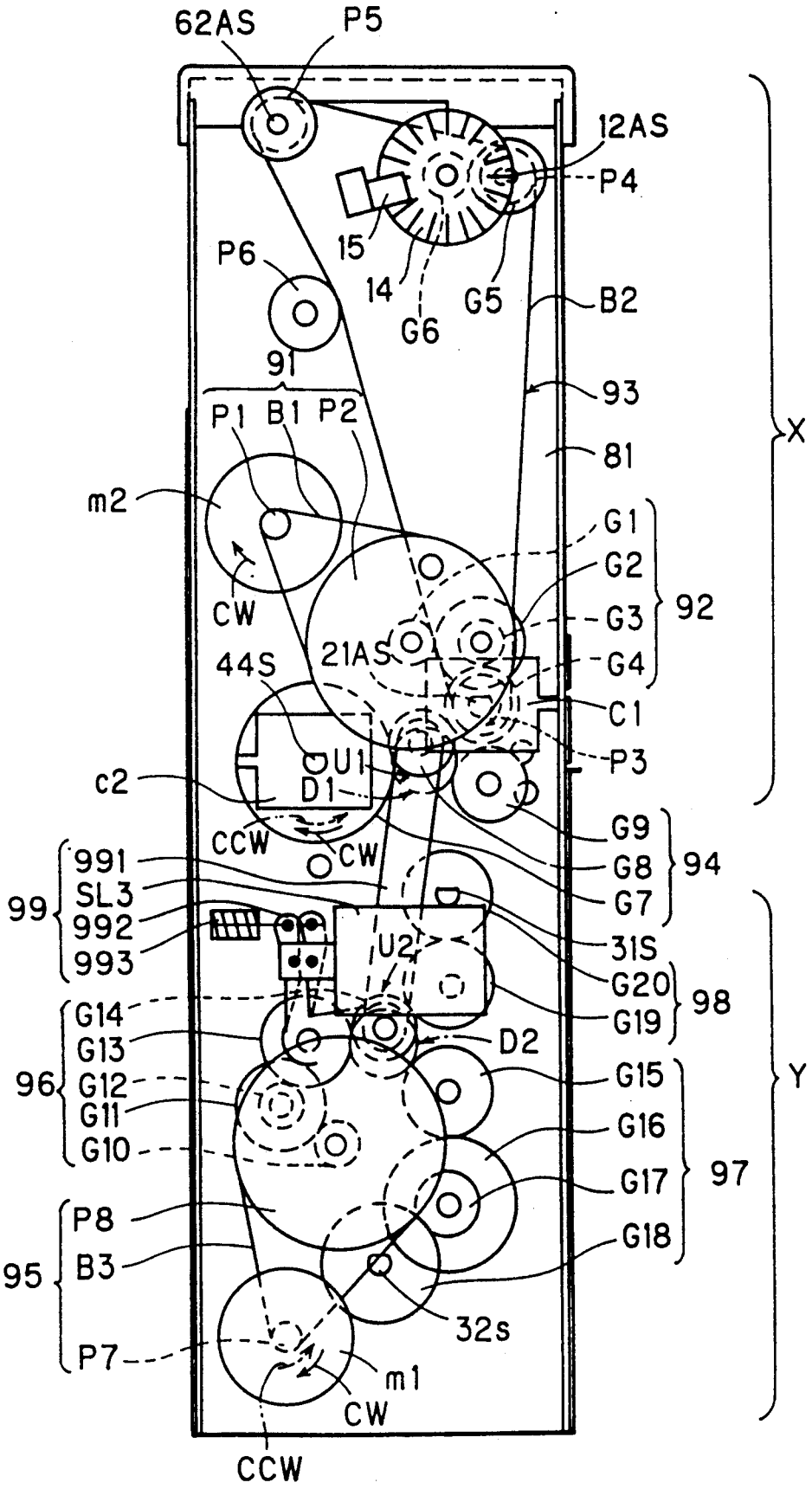
FIG. 9 is a side view showing the arrangement of rollers and belts incorporated in the sheet refeeding device.
Figure 10:
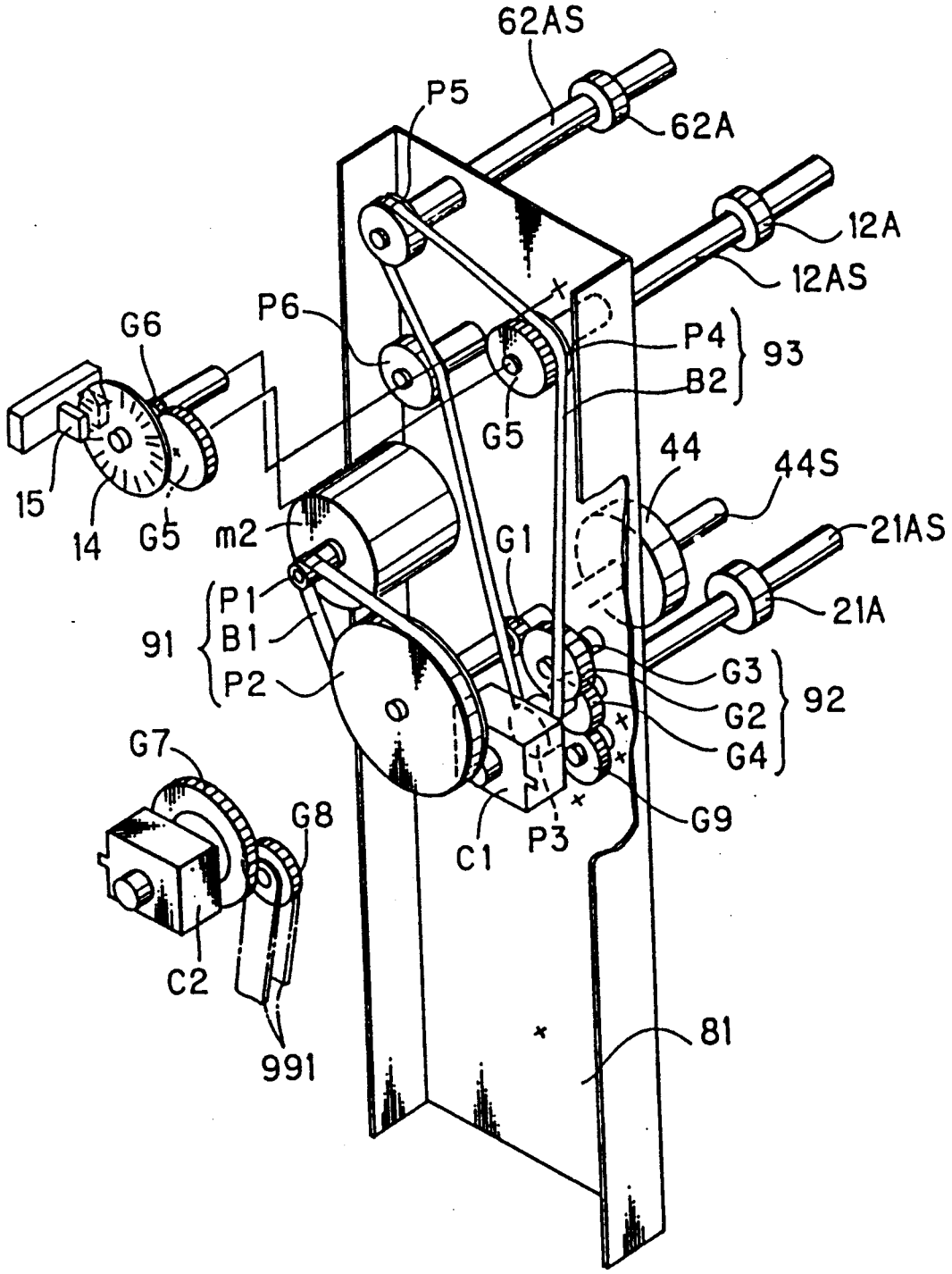
FIG. 10 is a perspective view showing the roller driving section of the sheet refeeding device.
Figure 11:
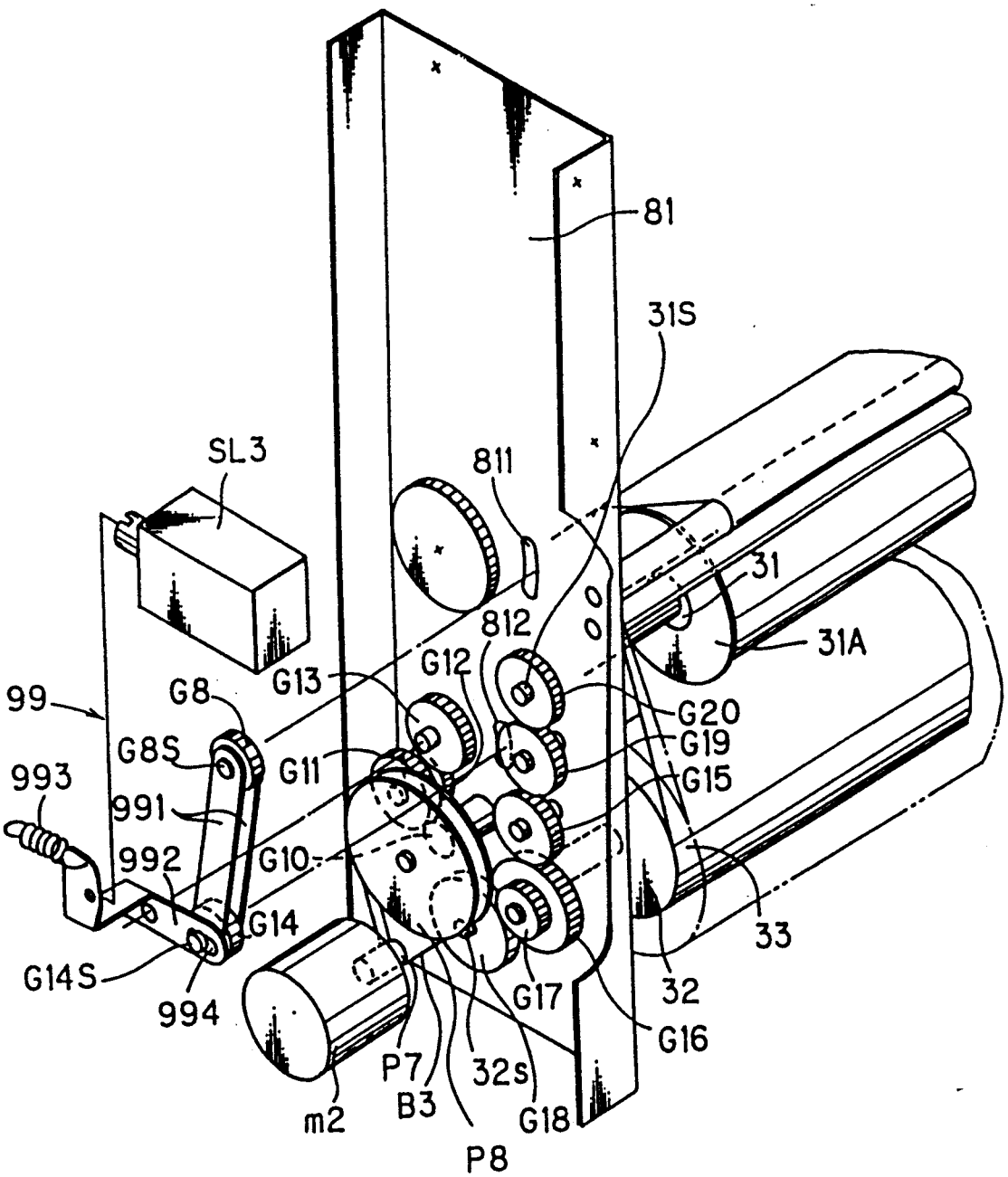
FIG. 11 is a perspective enlarged view showing the belt driving section of the sheet refeeding device.

The driving mechanism for operating the rollers and winding shafts referred to above will be described:

Referring to FIGS. 9 to 11 the driving mechanism is provided outside the far side plate 81. The views of the side plate 81 shown in FIGS. 9 to 11 and in FIG. 3 show one side and the opposite side of it. As shown in FIG. 9, the upper half portion X is a system for driving the rollers, and the lower half portion Y is a system for driving the web.

The system X includes a motor $m_2$, a first belt drive unit 91, a first gear train 92, a second belt drive unit 93 and a second gear train 94.

The first belt drive unit 91 includes a driving pulley P1 secured to a shaft of the motor $m_2$, a follower pulley P2 and an endless belt B1. The gear train 92 includes a gear G1 secured to a shaft of the follower pulley P2, and gears G2 to G4. The gear G4 is releasably fixed to a shaft 21AS of the roller 21A in the delivering section 2 through a clutch C1. The second belt drive unit 93 includes a pulley P3 secured to the shaft 21AS, a pulley P4 secured to a shaft 12AS of the roller 12A in the receiving section 1, a pulley P5 secured to a shaft 62AS of the roller 62A in the discharging section 6 and an endless belt B2 running on these pulleys. The reference numeral P6 denotes a tension roller.

The gear train 94 includes a gear G7 releasably fixed to a shaft 44S of the roller 44 in the sheet introducing section 4 through a clutch C2, a gear G9 of the same size with the gear G4 and meshing therewith, and a gear G8 meshing with the gears G7 and G9. As shown in FIG. 9, the gear G8 can ascend up to a position U1 and descend down to a position D1 by means of a lifting mechanism 99, which will be described below. At the position U1 the gear G8 meshes with the gears G7 and G4, and at the position D1 it meshes with the gears G7 and G9. When the motor $m_2$ is rotated in the CW direction in FIG. 9, the roller 44 rotates in the CCW direction (when the gear G8 is up) or in the CW direction (when the gear G8 is down) in FIG. 3. Even if the motor $m_2$ and the gear G7 continue to rotate, the clutch C2 enables the repetition of the rotating and stopping of the roller 44.

The clutches C1 and C2 are driven by solenoids; the clutch C1 disconnects the gear G4 from the shaft 21AS when it is on, and the clutch C2 connects the gear G7 to the shaft 44S when it is on.

The web driving mechanism will be described:

The web driving mechanism includes a motor $m_1$, a belt drive unit 95, a first gear train 96, a second gear train 97, and a third gear train 98. The belt drive unit 95 includes a driving pulley P7 secured to a shaft of the motor $m_1$, a follower pulley P8, and an endless belt B3 running on these pulleys. The gear train 96 includes a gear 10 secured to a shaft of a pulley P8, and gears G11 to 14. The gear train 97 includes gears G15 to 18, wherein the gear 18 is secured to a shaft 32S coaxial of the lower winding shaft 32 in the sheet holding section 3. The gear train 98 includes gears G19 and G20, the gear G20 being secured to a shaft 31S coaxial of the upper winding shaft 31. The gear G14 is capable of ascending and descending by a lift 99, and as shown in FIG. 9, it meshes with the gears G13 and G19 at an upper position U2, and with the gears G13 and G15 at a lower position D2. When the motor $m_1$ is rotated in the CW direction in FIG. 9 with the gear G14 positioning at the upper position U2, the gear G20 rotates in the CW direction, thereby enabling the upper winding shaft 31 to rotate in the CCW direction. As a result, the web 33 is wound around the upper winding shaft 31 while being unwound from the lower winding shaft 32. When the motor $m_1$ is rotated in the CCW direction in FIG. 9 with the gear G14 being at the lower position, the lower winding shaft 32 rotates in the CCW direction in FIG. 3. As a result, the web 33 is wound around the lower winding shaft 32 while being unwound from the upper winding shaft 31.

As shown in FIG. 5, the shaft 31S coaxial of the upper winding shaft 31 projects through the side plate 82, and supports a pulley 311 at its end. Likewise, the shaft 32S coaxial of the lower winding shaft 32 projects through the side plate 82 and supports a pulley 321. The pulleys 311 and 321 carry a round belt 300 which can slip on them. When the upper winding shaft 31 is driven in the CCW direction, the pulley 311 is also rotated in the CCW direction. The lower winding shaft 32 rotates in the CW direction as a follower. The belt 300 acts on the pulley 321 to cause it to rotate in the CCW direction, but the pulley 321 slips on the belt 300. As a result, when the web 33 is wound around the winding shaft 31, the shaft 32 is prevented from idle rotation due to inertia or any other cause, thereby avoiding the loosening of the web 33. When the web 33 is wound around the lower winding shaft 32, the pulleys 321, 311 and the belt 300 act in the same manner, thereby preventing the web 33 from loosening owing to an idle rotation of the shaft 31.

The lifting system 99 for effecting the ascent and descent of the gears G8 and G14 is shown in FIGS. 9 to 11. The lifting system 99 includes a pair of vertical rods 991 and a horizontal lever 992. The rods 991 support the gear G8 by an upper shaft G8S, and the gear G14 by a lower shaft G14S. As best shown in FIG. 11, the shafts G8S and G14S are freely inserted in elongated holes 811 and 812 (FIG. 11) produced in the side plate 81 so that the shafts can move up and down therein. The lever 992 is movably supported by the shaft of the gear G13, and its rearward end is pulled by a spring 993 so that the forward end is raised. The lever 992 is provided with an elongated hole 994 at its forward end, and the shaft G14S is freely inserted in the elongated hole 994. A solenoid SL3 is connected to the lever 992 so as to enable the forward end of the lever 992 to descend. When the solenoid SL3 is deenergized, the gears G8 and G14 are forced upward by the spring 993 and positioned up. When the solenoid SL3 is energized, the gears G8 and G14 are forced downward against the spring 993.

It is important that the sheets are prevented from becoming loose or broken during winding and unwinding. To this end, when the sheet is to be wound around the shaft 32, the running speed of the web $V_W$ (which means the travelling speed of the sheet supported on the web 33) by the web driving mechanism is preferred to be slightly higher than the feeding speed of the sheet $V_R$ by the roller driving system. When the sheet is to be unwound from the shaft 32, the speed $V_W$ is preferred to be slightly lower than the speed $V_R$. To achieve this optimum relations between $V_W$ and $V_R$, the illustrated embodiment includes a controller which sets the speed $V_R$ by the roller driving system to a given value, and controls the rotations of the motor $m_1$ by monitoring the speed $V_W$ to keep the $V_W$ constant, thereby maintaining the relations $V_W > V_R$ or $V_W < V_R$. The controller is controlled by a signal sent from a micro-computer, which also controls part of the operation of the copying apparatus 100A.

More specifically, in FIGS. 9 and 10 the roller driving system is provided with a slitted disc 14 rotatably supported outside the side plate 81. The slitted disc 14 is rotated by the shaft 12AS of the roller 12A through the speed accelerating gears G5 and G6. The reference numeral 15 denotes a photo-sensor (photo-interrupter) located opposite to the slitted disc 14. The slitted disc 14 and the photo-sensor 15 cooperate to detect the sheet running speed $V_R$ as pulses PS1. A value decided on the basis of the pulses PS1 is compared with a reference value previously decided, and the rotation of the motor $m_2$ is controlled by a control means such as a feed back control so as to obtain the predetermined speed $V_R$.

The idle roller 34 in the web driving mechanism is to guide the web 33 and to detect the speed thereof. Another idle roller 35 is to constitute a path for helping the web 33 to constitute a path for the sheets. The roller 34 is coated with a frictional substance such as rubber so as to convert the running speed of the web into the rotation of the roller without loss. In order to prevent a slip between the roller 34 and the web 33 by increasing the area of contact therebetween, it is arranged that the tension roller 36 enables the web 33 to wind around the roller 34 by 180° or more. As shown in FIG. 5, the shaft of the roller 34 projects through the side plate 82 and is provided with a gear 341 at its projecting end. The gear 341 meshes with a gear 342 on a shaft of a slitted disc 343 rotatably supported on the side plate 82. There is provided a photo-sensor (photo-interrupter) opposite to the disc 343. The gears 341 and 342 are speed accelerating gears. The rotation of the disc 343 enables the detection of the speed $V_W$ as pulses PS2. The pulses PS1 and PS2 are compared with each other, and the rotation of the motor $m_1$ is controlled by a control means such as a feed back control so as to obtain the desired relationship between the speeds $V_R$ and $V_W$. The control means will be described below.

The method of controlling the speeds $V_R$ and $V_W$ is not limited to that mentioned above but various known methods can be adopted. When a constant drive is imparted to the rollers by the copying apparatus 100A, it is not always necessary to control the speed $V_R$. It is also possible to compare the pulse PS2 with a previously set reference value.

The important thing is that the speeds U1, U2, $V_R$ and $V_W$ have the following relationship, where U1 is a sheet running speed by the discharge rollers 121 in the copying apparatus 100A, and where U2 is a sheet running speed by the delivery rollers 122 in the copying apparatus 100A:

When the web 33 is wound around the shaft 32, $$U1 < V_R < V_W;$$

When the web 33 is unwound from the shaft 32, $$V_W < V_R < U2.$$

Again, referring to FIG. 3 the operation of the sheet refeeding device 100B will be described:

Copy sheets discharged from the copying apparatus 100A are received by the receiving section 1 from which they are fed to the sheet introducing section 4 or to the discharge section 6 by the change-over device 41. The sheets fed to the the sheet introducing section 4 are fed to the delivering section 2 or the sheet holding section 3 by the change-over device 43. The sheets fed to the delivering section 2 are returned or refed to the copying apparatus 100A for composite copying. The sheets fed to the holding section 3 are stored therein; more specifically, each sheet is led into the path formed by the web 33 and the scraper 38 and wound around the lower winding shaft 32 following the web 33 which is wound around it.

When the web 33 is unwound from the shaft 32 and wound around the upper winding shaft 31, the sheets are also unwound together with the web 33, and rise up by help of the scraper 38, and are led to the delivering section 2 by the sheet sending-out section 5. In this way they are again fed face down to the copying apparatus 100A.

The capacity for storing sheets in the sheet holding section 3 depends upon the effective length L of the web 33, that is, the running length of the web 33 from when it is fully wound around the upper winding shaft 31 up to when it is fully wound around the lower winding shaft 32. In FIGS. 15(1) to 15(3), suppose that the length of a sheet in the direction of feed is $L_p$, the distance between one sheet and the next in the sheet holding section 3 is $L_o$, and the total number of the sheets is $N_m$ in the section 3, the following relationship is established:

$$N_m \leq L/(L_p+L_o)$$

If the value of $L_o$ is determined, the value of $N_m$ will be determined. The value $L_p$ is different from sheet to sheet. To effectively use the length of the web 33 it is desired to minimize the distance between the sheets, and also to predetermine the numbers $N_m$ corresponding to the lengths of the sheets. The smaller the distance $L_o$ is, the number $N_m$ becomes large. The value of $L_o$ can be minus, which means that the sheets wound around the shaft 32 can partly overlap with each other.

In the sheet refeeding device 100B the number of sheets to be stored is predetermined in accordance with the kinds of sheets. When the sheets are wound up, the roller 44 and the winding shaft 32 are intermittently operated under the control of a micro-computer, which will be described below. As a result, the sheets are wound with shorter distances than the interval $L_R$ at which they are fed from the copying apparatus.

When the web 33 is unwound from the shaft 32, the winding shaft 31 and the rollers 44 are intermittently driven under the control of the micro-computer, so as to restore the shortened inter-sheet distance $L_o$ to its original length $L_R$. The control by the micro-computer will be described below.

Figure 12:
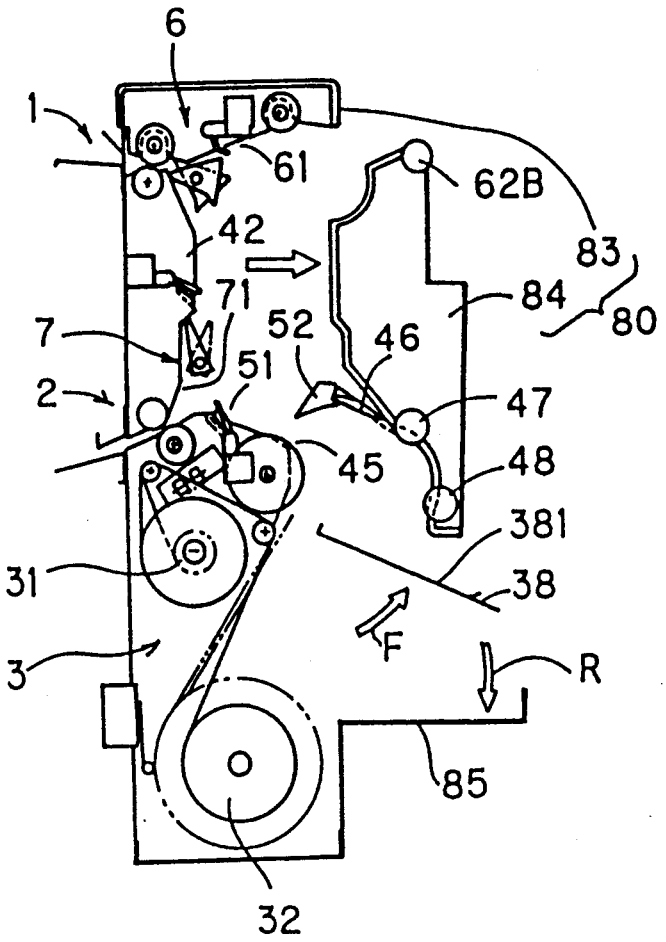
FIG. 12 is a cross-sectional side view showing the disassembling of the framework of the sheet refeeding device to remove a jamming of a sheet.
Figure 13:
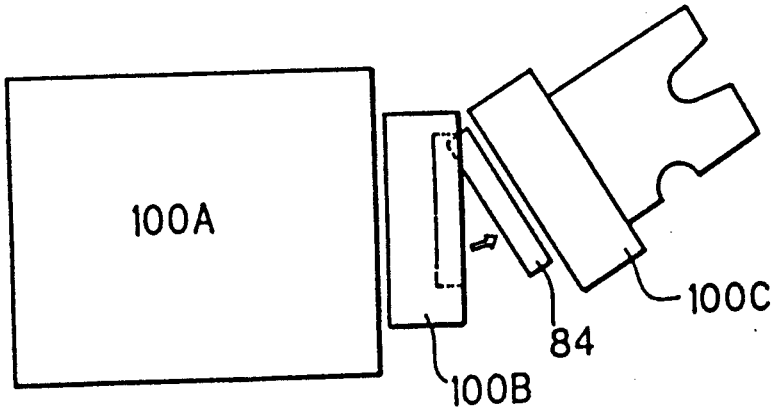
FIG. 13 is a schematic view showing the positional relationship between the sheet refeeding device and the sorter with respect to the main body of the copying apparatus.

In the sheet refeeding device 100B the rollers 47, 48 and 62B (FIGS. 3 and 12) are carried on a detachable portion 84 of a main body 83 of the framework 80, and the change-over guide 52 is carried on the detachable portion 84 together with the change-over device 46 by suitable arms (not shown). When the portion 84 is detached from the main body 83 as shown in FIG. 12, the paths 61, 42, 45, 51 and 71 are made accessible to remove a jamming therein. Alternatively the portion 84 can be openably hinged to the main body 83 as shown in FIG. 13, thereby making these paths accessible. The accessibility of these paths is largely due to the fact that the winding shafts 31 and 32 are spaced from the receiving section 1 and the delivering section 2.

As shown in FIG. 12, it is also possible that a frame plate 85 located at an opposite side to the copying apparatus 100A is made openable, and when the frame plate 85 is opened in the direction of arrow R in FIG. 12 so as to raise the scraper 38 and the guide 381 in the direction of arrow F, the sheet holding section 3 is made accessible to remove a jamming therein.

Figure 29:
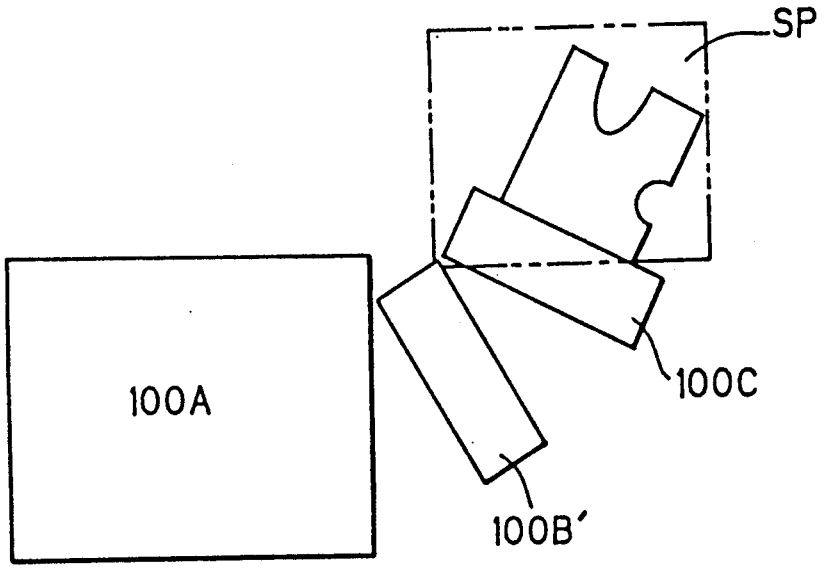
FIG. 29 is a schematic view showing a sheet refeeding device improperly attached to the copying apparatus.

If a jamming in the refeeding device must be removed from both sides thereof opposite the copying apparatus 100A and the sorter 100C, it would be required that a refeeding device 100B' is rotatably attached to the copying apparatus so that the device can be easily opened as shown in FIG. 29. In this case one problem is that a large space SP will be required for accommodating the sorter 100C. Another problem is that it is difficult to make the pivotal points strong enough to support the refeeding device 100B' rotatably. In contrast, the refeeding device 100B of the present invention, as shown in FIG. 13, can be securely fixed to the copying apparatus 100A, and when a jamming is to be dealt with, it has only to open the sorter 100C alone, thereby requiring no deep space SP for accommodation.

Figure 14:
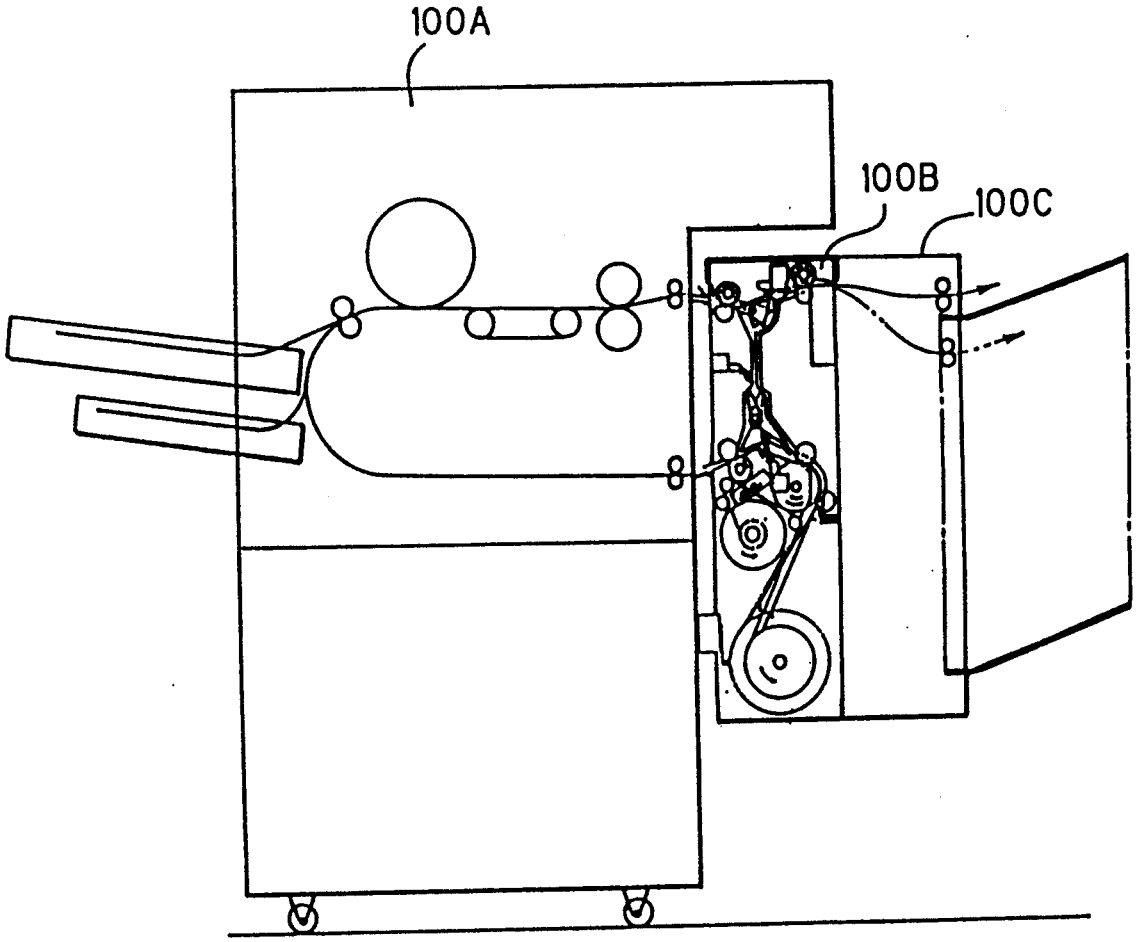
FIG. 14 is a schematic overall view showing a copying apparatus equipped with the sheet refeeding device and the sorter.

As is evident from FIG. 14, the refeeding device 100B has a vertically elongated shape, thereby minimizing the size of the copying apparatus 100A equipped with the refeeding device 100B because of the non-presence of an intermediate tray which the conventional copying apparatus would require in it for composite copying and double-face copying. In addition, when the refeeding device 100B and the sorter 100C are not used, it is possible to detach them from the copying apparatus. In this case it is an advantage that the copying apparatus having no refeeding device or sorter may be smaller than the conventional ones.

The refeeding device 100B is a rigid structure of a vertically elongated shape, and in hinging the sorter 100C to the refeeding device 100B the points of hinge can be fairly spaced, thereby making the joint strong. Another advantage is that a space below the discharge port of the copying apparatus can be utilized.

Referring to FIG. 16, the micro-computer referred to above (hereinafter called "CPU1") will be described. The CPU1 includes ROM1 and RAM1, and controls the operation of the copying apparatus 100A:

The input terminals of the CPU1 are connected to a switch matrix 126 including the keys K1 to K20 on the operation panel 125, a micro-switch MS1 disposed on the copying apparatus 100A to detect the presence of the sheet refeeding device 100B, and various sensors. The output terminals are connected to the display DS (four-digits) on the operation panel 125 and a matrix including the light-emitting diodes LED 1 to 25, which are operated by the CPU 1 through a decoder 127. In order to control the copying apparatus, the output terminals are also connected to drive circuits A1 to A8 for the main motor M1, the developing motor M2, the timing roller clutch CL1, the upper sheet feeder clutch CL2, the lower sheet feeder clutch CL3, the main charger 107, and the transfer charger 111, etc., respectively.

Through a bus 128 the CPU1 communicates with another micro-computer, hereinafter called "CPU 2". The CPU2 includes ROM2 and RAM2, and controls the sheet refeeding device 100B. The CPU1 sends a signal to the CPU2 relating to the condition of the copy flag depending on the pressing of the key K 21, the number of sheets to be copied set by the ten keys K1 to K10, a copying mode selected by the rotation key K18, and others.

The CPU2 sends a signal to the CPU1 relating to the terminations of a first copying and holding a predetermined number of sheets in the double-face copying mode, and the prohibition of copying operation until the change-over operation in the device 100B is finished when the copy mode is changed.

The CPU2 is mounted on the refeeding device 100B. The input terminals of the CPU2 are connected to the sheet passage detecting sensors SE1 to SE4, and the abnormality detecting sensor SE5, and the belt end detecting sensor 37, etc. The output terminals are connected to the motor $m_1$, $m_2$, the clutches C1 and C2, drive circuits D1 to D7 for the solenoids SL1 to SL3.

The CPU2 is also connected to control circuits Q1 and Q2 for controlling the speeds of the motors $m_1$, $m_2$ to constant values to meet a requirement for achieving the predetermined relationship.

The circuit Q1 compares a voltage obtained through the conversion of the frequency of an output pulse PS1 of the photo-interrupter 15 with a reference voltage generated by a reference voltage generating circuit Q3, and determines a voltage for driving the motor $m_2$ so as to make the output pulse PS1 constant, thereby securing a constant speed of the motor $m_2$.

The circuit Q2 compares the reference voltage with a converted voltage of the PS2, and determines a voltage for driving the motor $m_1$ so as to make the running speed $V_W$ of the web 33 constant, thereby securing a constant speed of the web 33.

On or off signals for the motors $m_1$ and $m_2$ are delivered from the output terminals P1 and P2 of the CPU2.

As described above, it must be arranged so that the web running speed $V_W$ is slightly higher than the sheet feeding speed $V_R$ when the sheet is wound around the lower winding shaft 32, and $V_W$ is slightly lower than $V_R$ when the sheet is unwound from the lower winding shaft 32. In order to change $V_W$, CPU2 delivers a signal from the output terminal P3 through a line such as a 2-bit signal line, which allows that when P3=0 1, $V_W$ is lower than $V_R$, and that when P3=1 0, $V_W$ is higher than $V_R$.

The CPU1 is connected to another micro-computer (not shown) which controls the optical scanning system for controlling the scanning of an original document. Motor controlling circuits, detecting switches and other components of the system are connected to the micro-computer.

The CPU1 also functions to restore the copying conditions to the initial copy mode. The copying conditions include the number of sheets to be copied, the copying magnification, the size of sheet, the copy image density, the copy mode (i.e. single-face, double-face or composite copying). The initial mode can be various; for example, the number of sheets to be copied is 1, the magnification is 1×1, the paper size is A4 (lateral), the copy image density is intermediate, and the copy mode is single-face.

Referring to FIGS. 17 to 21, which show the flowcharts the operation of the CPU1 will be described:

In the following description the "on edge" means the change of state from the "off" of a switch, sensor, signal, etc. into "on". The "off-edge" means the change of state from the "on" of a switch, sensor, signal, etc. into the "off".

Each step in the flowcharts will be designated # and a numberal such as #100, which denotes "step No. 100".

Figure 17:
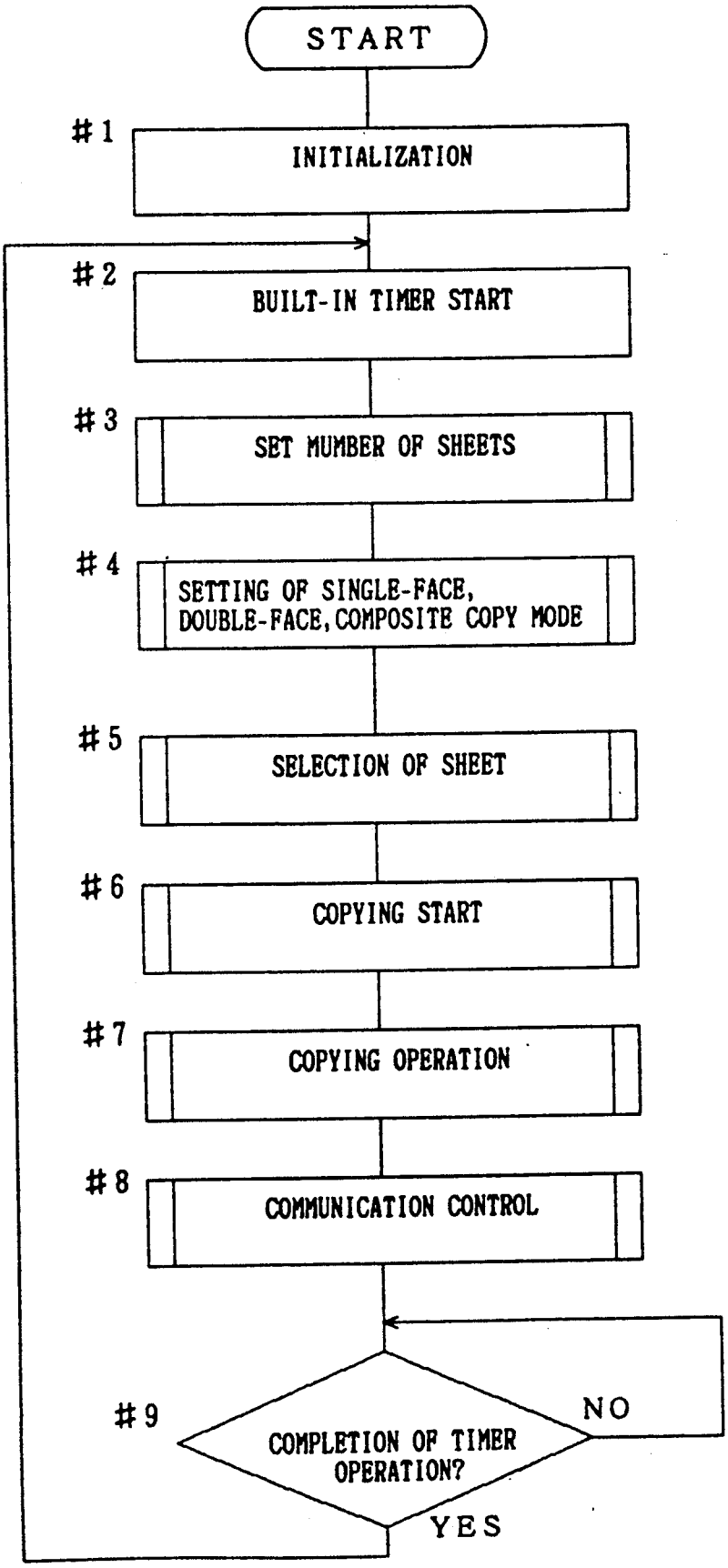
FIG. 17 is a flowchart showing a main routine executed by the micro-computer CPU1 to control the copying apparatus.

FIG. 17 is a flowchart showing a main routine for the CPU1. According to the routine the CPU1 is reset, and the program starts and the micro-computer is initialized for the clearing of the RAM1, the setting of various registers in the CPU1, and the initialization of the copying apparatus 100A (step #1).

In step #2 the built-in timer in the CPU1 is started, and in steps #3 to #8 subroutines are respectively called into action. When all the subroutines are dealt with, one routine finishes upon lapsing of the initially set built-in timer in step #9, and the sequence returns to step #2.

Step #3 is a routine for an operator to input the number of sheets to be copied, step #4 is a routine for the operator to set any of single-face, double-face or composite copy mode, step #5 is a routine for the operator to set a sheet size, step #6 is a routine for checking if a copying is practicable in the mode selected by the inputs of the number of sheets and the sheet size, step #7 is a routine for effecting the copying operation, and step #8 is a routine for communicating with the CPU2 and other micro-computers.

Figure 18:
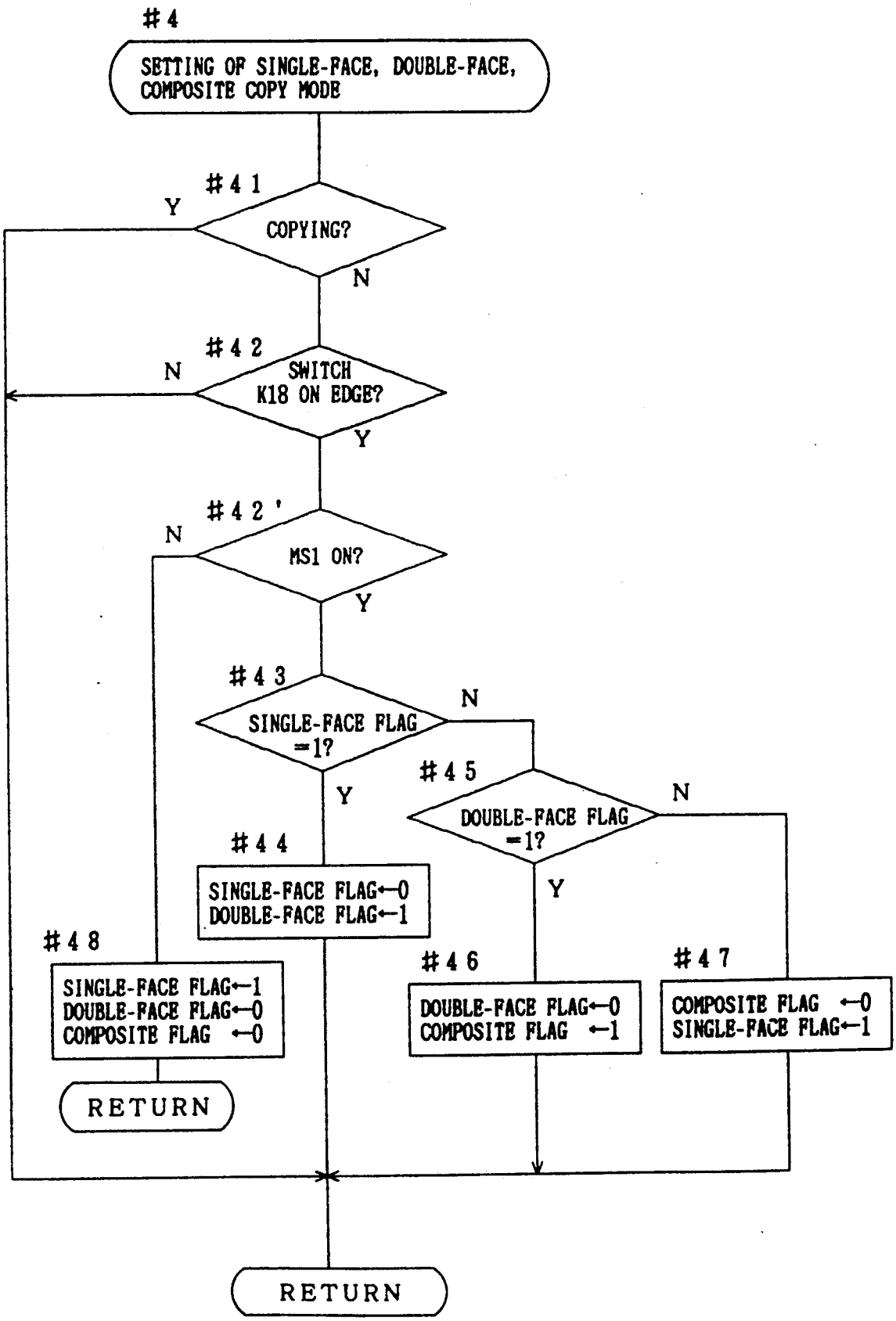
FIG. 18 is a flowchart showing a routine for setting a copy mode.

Referring to FIG. 18 the routine for setting a copy mode will be described:

Step #41 checks if the copying apparatus is in copying operation. When it is found to be out of operation, step #42 checks if there is an "on edge" under the pressing of the key K18 for selecting a copy mode, and when there is the "on edge", step #42 checks if the switch MS1 is on, that is, whether the sheet refeeding device 100B is attached to the copying apparatus 100A. When the answer is "No", that is, it is found to be not equipped, the sequence returns after setting the single-face flag to "1", and the double-face and the composite flags each to "0" (step #48). When the answer is "Yes", that is, it is found to be equipped, step #43 checks if the single-face flag is "1" (LED1 is on), and when it is "1", step #44 sets the single-face flag to "0" (LED1 is off), and then sets the double-face copy mode by setting the double-face flag to "1" (LED2 is on). The sequence returns. At this stage when the switch K18 is pressed again step #45 checks if the double-face flag is "1" (LED2 is on). When it is "1", step #46 sets the composite copy mode by setting the double-face flag to "0" (LED2 is off), and the composite flag to "1" (LED3 is on). The sequence returns. When the switch K18 is again pressed, step #47 sets the single-face copy mode (LED3 is off and LED1 is on). In this way the pressing of the switch K18 determines the single-face, double-face or composite copy mode as desired. If the step #41 finds the copying in operation or if the step #42 finds no "on edge" by pressing the switch K18, the sequence returns to the main routine.

Figure 19:
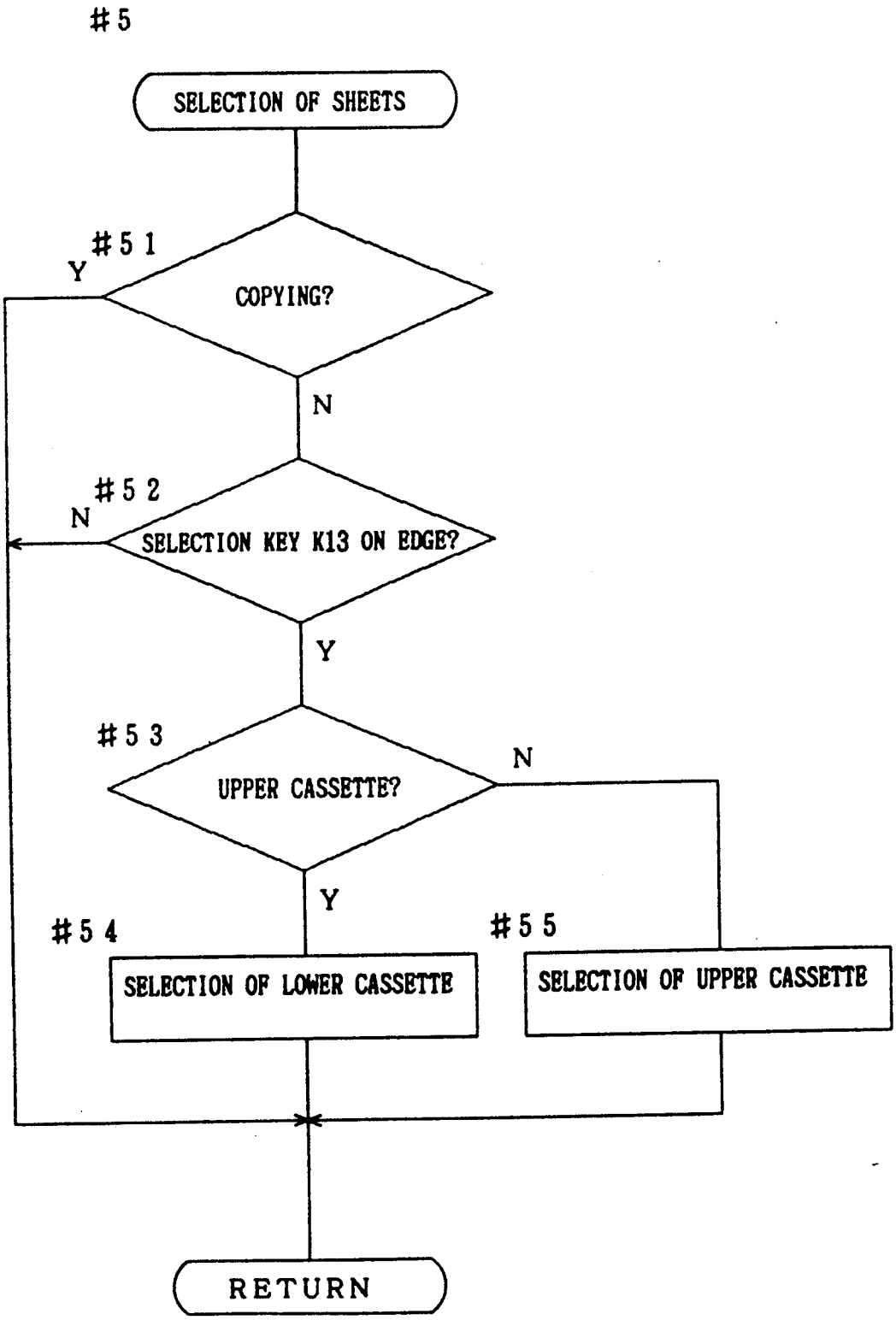
FIG. 19 is a flowchart showing a routine for selecting sheets.

Referring to FIG. 19, the routine for selecting the sheet will be described:

Step #51 checks if the copying apparatus 100A is in copying operation. When it is found to be not in operation, step #52 checks if there is an "on edge" under the operation of the key K13, and when the "on edge" is found, step #53 checks if the upper cassette 114 is selected (in the illustrated embodiment the paper size is A4 lateral). When it is selected, step #54 selects the lower cassette 116 (in the illustrated embodiment the paper size is B5 lateral). The sequence returns. When the lower cassette 116 is selected, the key K13 is again pressed, step #55 selects the upper cassette 114, and the sequence returns. In this way the repeated pressing of the key K13 can select A4 size sheets in the upper cassette or B5 size sheets in the lower cassette. If the step #51 finds the copying in operation or if the step #52 finds the key K13 not pressed, the sequence returns.

Figure 20:
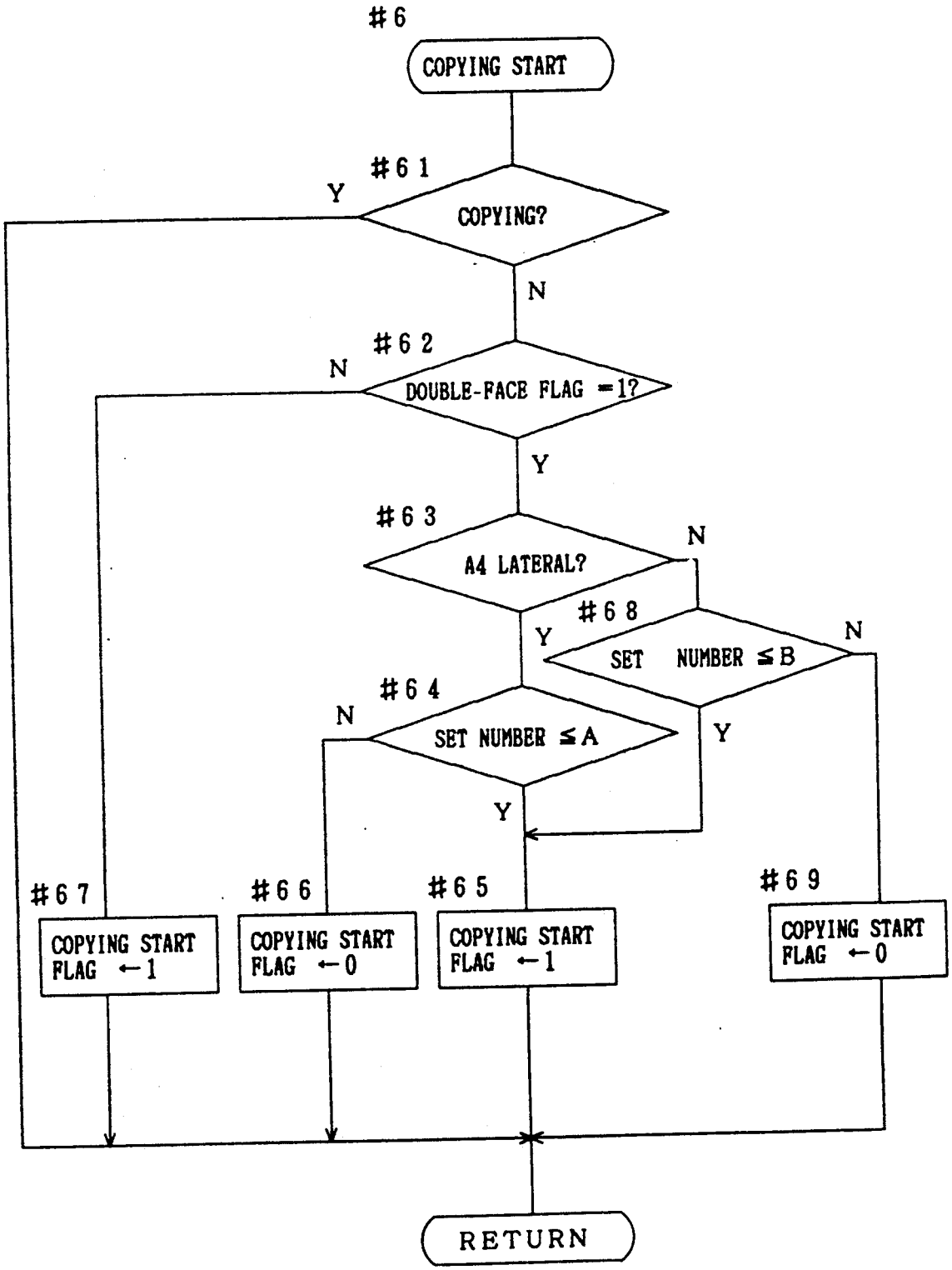
FIG. 20 is a flowchart showing a routine for starting the copying operation.

Referring to FIG. 20, the routine for starting the copying operation will be described:

Step #61 checks if the copying apparatus is in copying operation. When it is found to be in operation, the sequence returns but if not, step #62 checks if the double-face copy mode is set. When it is not set, step #67 sets a copying start flag to "1" whereupon the copying can be performed in the single-face or the composite copy mode.

When step #62 selects the double-face copy mode, step #63 checks if the sheet size is A4 lateral or B5 lateral. When it is A4 lateral, step #64 checks if the number of sheets previously set by an operator is not more than the predetermined reference number (A), and when it is not more than the reference number (A), sets the copy start flag to "1" in step #65. When it is found to be more than it, step #66 sets the copy start flag to "0".

When step #63 finds that the A4 size is not selected, which means that the B5 size is set, step #68 checks if the number of sheets previously set by an operator is not more than the predetermined number (B), and when it is not more than the number (B), sets the copy start flag to "1" in step #65. When it is found to be more than it, step #69 sets the copy start flag to "0". The number (A) and (B) each mean the maximum number of sheets placed on an effective length (L) of the web 33 to be wound around the winding shaft. Each value satisfies the following relation:

$$N_m \leqq L/(L_p+L_o)$$

The values (A) and (B) are previously stored in the CPU1. When steps #66 or 69 sets the copy start flag to "0", the copying will never be started by pressing a print button K21 on the operation panel.

Figure 21A:
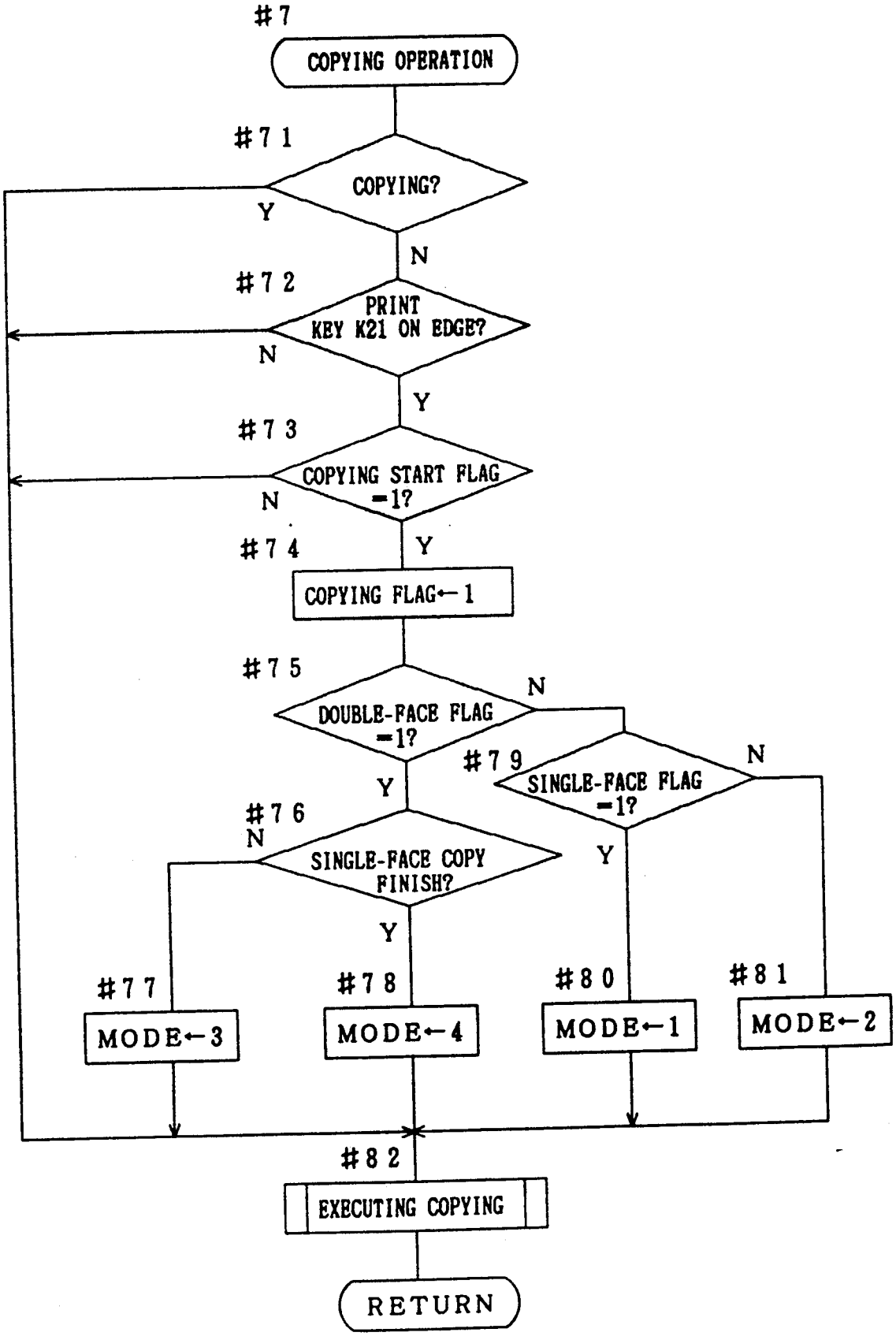
FIG. 21*a* is a flowchart showing a routine for performing the copying operation.

Referring to FIG. 21*a*, the routine for prosecuting the copying will be described:

In the flowchart of FIG. 21*a* the copy flag of step #74 is to put the routine of step #82 into action so as to start the copying. When the print button K21 is pressed in a state where the copying is ready, the copy flag of step #74 becomes "1" for a period of time starting from the pressing of the button K21 until the copying of the set number of sheets is finished.

A mode (1) signal indicates a single-face copy mode, a mode (2) signal indicates a composite copy mode, and a mode (3) signal is a mode for accommodating a sheet having an image on its one side in the sheet holding section 3 of the refeeding device 100B. A mode (4) signal indicates a mode for refeeding the sheet from the holding section 3 to the copying apparatus.

Initially, step #71 checks if the copying apparatus is in copying operation, and when it is not in operation, step #72 checks if the print button K21 is pressed. When the button K21 is pressed, step #73 checks if the copy start flag is "1", and when it is "1" step #74 sets the copy flag to "1".

Then, step #75 checks if the double-face copy mode is set, and when it is set, step #76 checks if one face copy has been finished for the set number of sheets. If it is not finished, step #77 sets a mode signal to the mode (3), wherein the mode signal is to be sent to the sheet refeeding device 100B (CPU2). When the one face copy is finished for the set number of sheets, step #78 sets a mode signal to the mode (4), wherein the mode signal is sent to the CPU2.

When in step #75 the double-face copy mode is not selected, step #79 checks if the single-face copy mode is selected. If it is selected, step #80 sets the mode signal (1). If the single-face copy mode is not selected (for the composite copy mode), step #81 sets the mode signal (2).

When the mode signal is set in any of steps #77 to 81, step #82 performs the routine for prosecuting the copying, wherein this routine is for prosecuting the copying on the basis of the signals delivered by step #1 to step #6. Step #76 judges the completion of the front side copy for the set number of sheets by a point of time when the set number of sheets have been accommodated in the refeeding device 100B with a copy on one face after the copying is started with the double face flag being "1" and the print button K21 being first on edge.

Figure 21B:
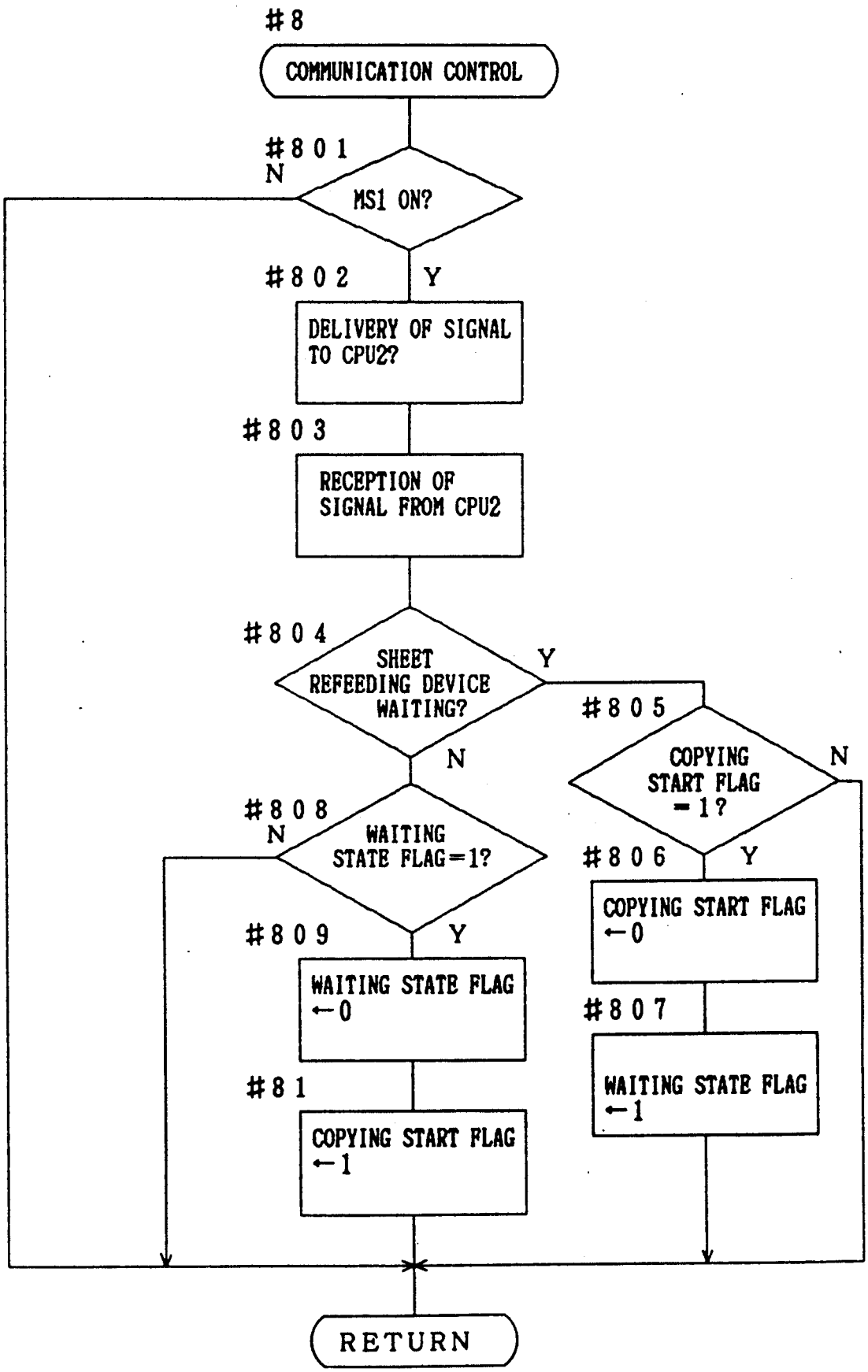
FIG. 21*b* is a flowchart showing a routine for executing communication control.

Referring to FIG. 21*b*, the routine for controlling the communication between the CPU1 and the CPU2:

When the switch MS1 is on the step #801, which means that the sheet refeeding device 100B is attached to the copying apparatus, in step #802 the CPU1 delivers the above-mentioned signals to the CPU2, wherein the CPU1 requires the CPU2 to send a signal indicating the condition of the refeeding device 100B thereto. In step #803 the CPU2 sends a signal indicating whether the refeeding device 100B is ready for the subsequent operation, and whether the number of the first copied sheets accommodated in the device 100B is in agreement with the set number of sheets.

Step #804 checks if the refeeding device 100B is prepared for the subsequent operation, and when it is in a prepared state, and when step #805 finds that the copy start flag is "1", which means that the copying operation is ready, step #806 sets the copy start signal to "0", and then step #807 sets the waiting flag to "1". The sequence returns. When the copy start flag is not "1" in step #805, the sequence returns immediately from step #805.

With the waiting state of the refeeding device 100B being released (where step #804 is answered by "No"), if step #808 finds that the waiting flag is "1", step #809 resets it to "0" and step #810 sets the copy start flag to "1". If the waiting flag is not "1" in step #808, the sequence returns immediately from step #808.

When the micro-switch MS1 is off in step #801, it indicates that the refeeding device 100B is not attached to the copying apparatus, the CPU1 need not communicate with the CPU2, and the sequence skips steps #802 to #810 and returns immediately from step #801.

Figure 22:
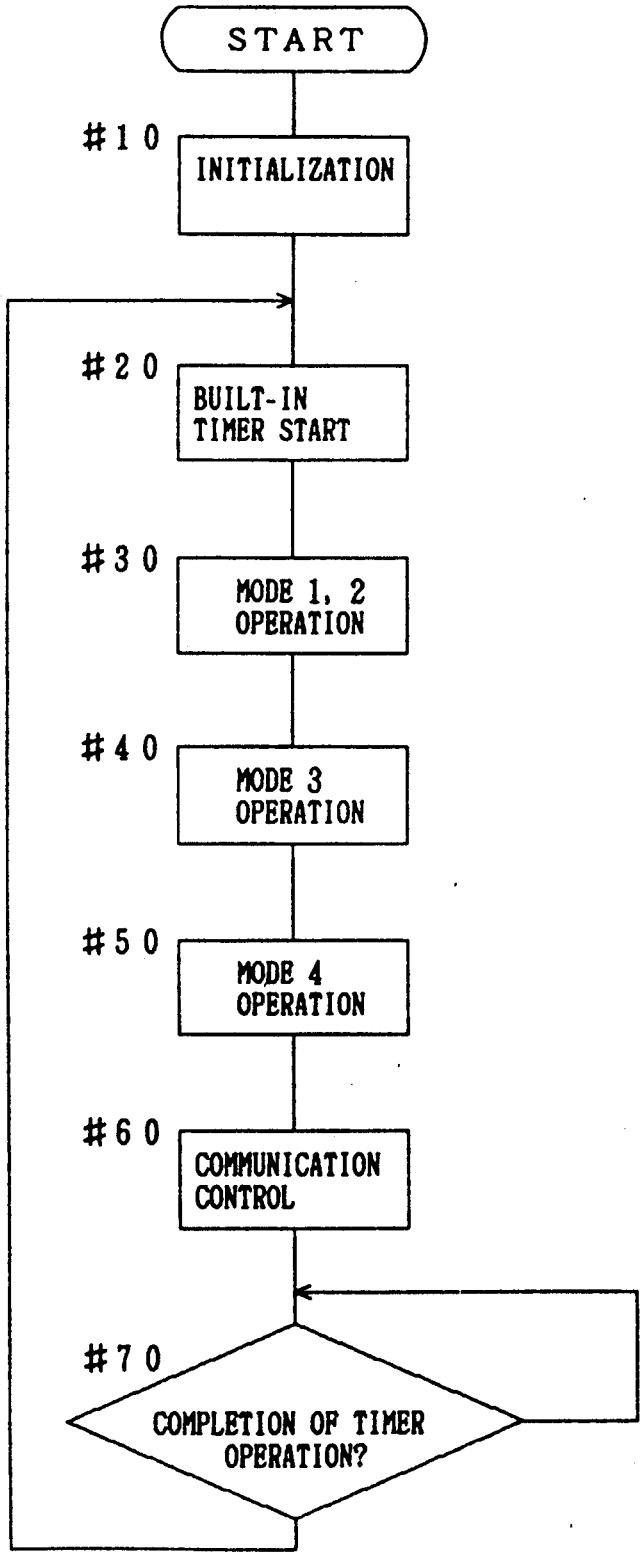
FIG. 22 is a flowchart showing a main routine for controlling the sheet refeeding device by CPU2.

Referring to FIGS. 22 to 26, the operation of the CPU2 in the sheet refeeding device 100B will be described:

FIG. 22 is a flowchart showing a main routine under which the CPU2 performs controls:

According to the routine the CPU2 is reset, and the program starts. Step #10 initializes the CPU2, such as the clearing of the RAM2, the setting of various registers, etc. and also initializes the refeeding device 100B.

Step #20 starts a built-in timer within the CPU2. Steps #30 to #60 are respectively called in action, and when all the subroutines are performed, one series of routine finishes upon lapsing of the time set by the built-in timer in step #70. The sequence returns to step #20.

The step #30 is a subroutine for executing a mode (1) (single-face copy mode) and a mode (2) (composite copy mode), step #40 is a subroutine for executing a mode (3) (for winding sheets in the double-face copy mode), and step #50 is a subroutine for executing a mode (4) (for unwinding sheets in the double-face copy mode).

On the basis of the period of time for which one main routine is completed, the time of each timer used in each subroutine is counted. More specifically, the lapsing of time set by each timer is judged by counting the number of repetitions of one routine. During the initialization in step #10 the motor $m_1$, $m_2$, the clutch C1, C2 and the solenoids SL1 to SL3 are kept off.

Figure 23:
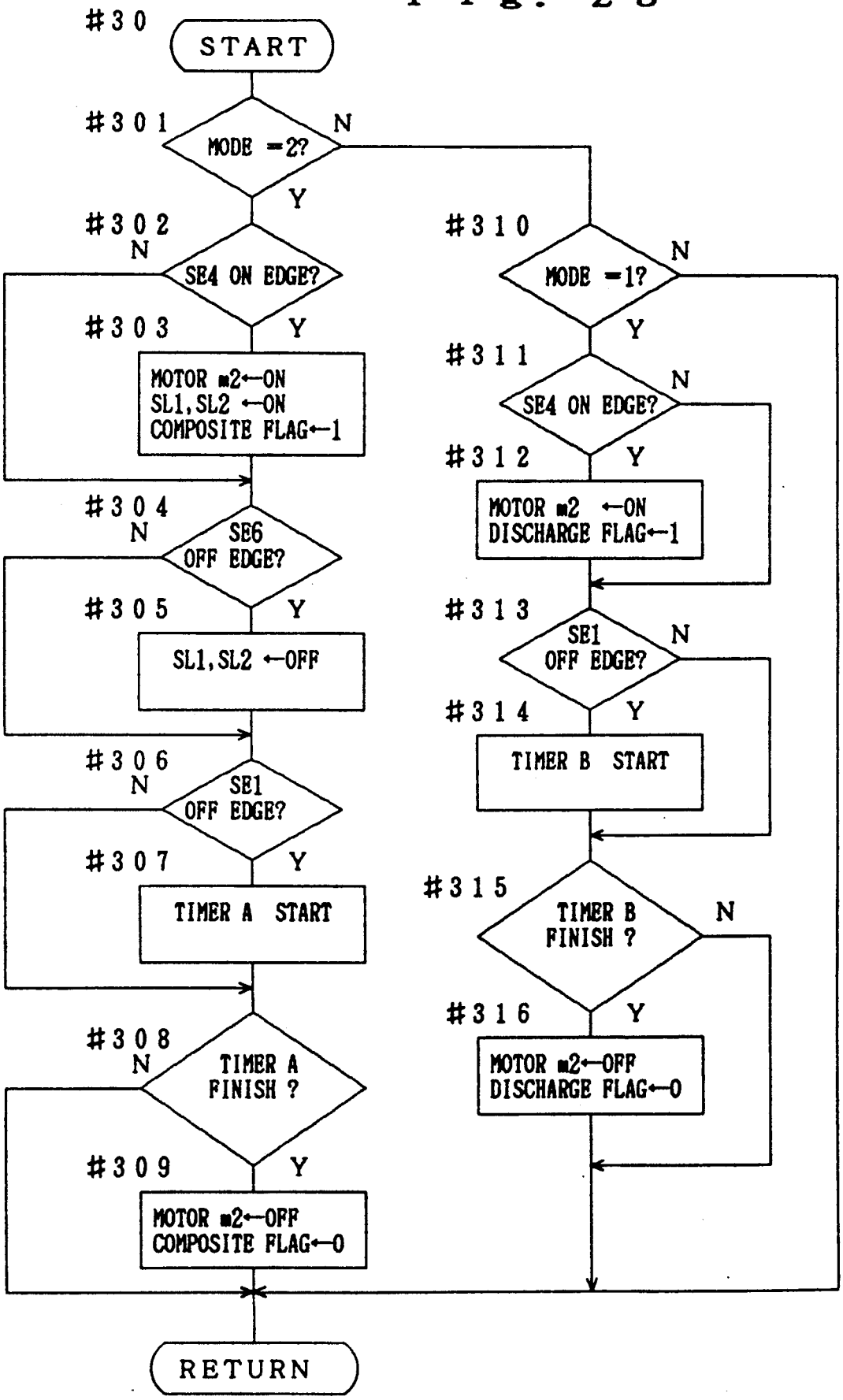
FIG. 23 is a flowchart showing a routine for executing the mode (1) and (2)

Referring to FIG. 23, the routine for executing the modes (1) and (2) will be described:

Step #301 checks if the mode signal sent from the copying apparatus is the mode (2), and when it is the mode (2), the sequence advances to step #302. Step #302 checks if a sensor SE4 disposed in the receiving section 1 of the refeeding device 100B detects the forward end of a sheet by the sensor SE4, and when it is detected, step #303 turns on the motor $m_2$ to drive the rollers 12A, 62A and 21A, and turns on the solenoids SL1 and SL2 which constitute a composite return path so as to enable their bars 411 and 431 to position at positions T2 ad Q2 shown in FIG. 3, and sets a composite flag to "1" wherein the composite flag is to indicate the prosecution of the composite operation.

Step #304 checks if a sensor SE6 disposed in the sheet delivering section 2 detects the rearward end of the sheet, and when it is detected, step #305 turns off the solenoids SL1 and SL2 so as to return the bars 411 and 431 to the positions T1 and Q1 initially set, and prepares for feeding the sheets refed to the copying apparatus to the discharge tray 60.

Step #306 checks if the sensor SE1 disposed in the sheet discharging section 6 detects the rearward end of a sheet, and when it is detected, step #307 turns on a timer (A) to drive the motor $m_2$ until the sheet is discharged. When the time set by the timer (A) lapses in step #308, the motor $m_2$ is turned off in step #309, and the composite flag is reset to "0".

When step #301 finds that the mode signal from the copying apparatus is not the mode (2), step #310 checks if the mode signal is the mode (1). When it is the mode (1), the sequence advances to step #311, and when it is not the mode (1), the sequence returns to the main routine.

When step #310 finds that the mode signal is the mode (1), the sequence advances to step #311. Step #311 checks if the sensor SE4 disposed in the receiving section 1 detects the forward end of the sheet, and when it is detected, step #312 turns on the motor $m_2$ to drive the rollers 12A and 62A, and sets the discharge flag to "1" so as to indicate that the sheet is being discharged.

Then, step #313 checks if the sensor SE1 detects the rearward end of the sheet, and when it is detected, step #316 turns off the motor $m_2$ upon lapsing of the time set by a timer (B) for which the sheet is fed out to the discharge tray 60, thereby stopping the rollers 12A and 62A and setting the discharge flag to "0".

Referring to FIGS. 24(1) and 24(2), the routine for executing the mode (3), wherein the rotations of the motor $m_1$ for the mode (3) are predetermined to satisfy the relation ($V_R < V_W$):

Step #401 checks if the mode signal from the copying apparatus 100A is the mode (3). When it is not the mode (3), this routine finishes. When it is found that it is the mode (3), step #402 checks if a sensor SE4 disposed in the receiving section 1 of the refeeding device 100B detects the forward end of a sheet. When it is detected, the sequence advances to step #403. Step #403 turns on the solenoid SL1 to position the bar 411 at the position T2 shown in FIG. 3, thereby leading the sheet to the sheet holding section 3, turns on the motor $m_2$ to drive the roller 12A, and turns on a solenoid SL3 to engage the gears with each other, thereby allowing the winding shaft 32 to be driven to wind the web 33 (i.e. sheets) around its own. At the same time, step #403 sets the accommodation flag to "1" to indicate that the sheets are being accommodated.

Step #404 checks if the sensor SE2 disposed in the sheet introducing section 4 detects the forward end of a sheet, and when it is detected, the timer (C) starts and the counter (N) (initialization value=0) is incremented. The time $T_C$ set by the timer (C) is shorter than a period of time for which the forward end of a sheet reaches the nip between the rollers 44 and 47.

Step #406 checks the completion of the timer (C) operation, and when it is found, and when the timer (C) flag is set to "1", step #408 turns on the motor $m_1$ for driving the web 33 and also turns on the clutch C2 to drive the roller 44.

Step #409 checks if the sensor SE2 disposed in the sheet introducing section 4 detects the rearward end of a sheet, and when it is detected, the sequence advances to step #410. Step #410 compares the value (N) counted in step #405 and the value ($N_0$) sent from the copying apparatus, wherein the value ($N_0$) represents the set number of sheets to be copied. As a result of comparison, when the value (N) is not equal to the value ($N_0$), the sequence advances to step #411.

Step #411 turns on a timer (D). By reference to a time $T_D$ set by the timer (D) the distance $L_C$ between one sheet and the next on the shaft 32 is determined.

Step #412 checks the completion of the timer (D) operation, and when it is completed, the sequence advances to step #413. Step #413 turns off the motor $m_1$ and the clutch C2 to stop the sheet accommodating operation in the section 3.

Step #414 checks if the sensor SE5 detects any abnormality and the sensor 37 detects the mark 331 or 332 on the web 33, and when they are detected, step #418 turns off the motor $m_2$ and the solenoid SL1 to stop all operations of the refeeding device 100B, and sets the over-capacity flag to "1", wherein the over-capacity flag indicates that the winding operation is abnormal.

When step #410 judges that the value (N) is equal to the value ($N_0$), step #415 turns on a timer (E) to set a time $T_E$ which continues until the rearward end of the last one of the sheets to be accommodated in the holding section 3 passes through the lower end 383 (FIG. 3) of the scraper 38.

When step #416 detects the completion of the timer (E) operation, step #417 turns off the motors $m_1$, $m_2$, the solenoid SL1 and the clutch C2, and resets the accommodation flag to "0" and the timer (C) flag to "0". The solenoid SL3 for driving the gear trains is also turned off.

Referring to FIGS. 25(1) and 25(2), the routine of step #50 for executing the mode (4) will be described, wherein the rotations of the motor $m_1$ in the mode (4) is previously set so as to obtain the relation ($V_R > V_W$):

Step #501 checks if the mode signal from the copying apparatus 100A is the mode (4). When it is not the mode (4), this routine finishes.

When step #501 finds that it is the mode (4), step #502 checks if there is an "on edge" by the operation of the print key switch K21. When there is the "on edge", step #502' checks if the sheet refeeding flag is "0", and when it is "0", the sequence advances to step #503. Step #503 turns on the motor $m_2$ and the clutch C2 to drive the rollers 44 and 21A, thereby executing the sheet refeeding operation, and turns on the motor $m_1$ to unwind the web 33 from the winding shaft 31. Step #503 also sets the refeeding flag to "1", wherein the refeeding flag is to indicate that the refeeding is in progress. The pair of rollers 21A and 21B are driven by the motor $m_2$, and when the clutch C1 is turned on, the rollers 21A. 21B are stopped.

Step #504 checks if the sensor SE3 disposed in the sheet introducing section 5 detects the rearward end of the sheets unwound from the shaft 31. When the rearward end of the sheet is detected, step #505 turns off the motor $m_1$ to stop the unwinding of sheets from the holding section 3, and turns off the clutch C2 to stop the roller 44. At this stage the counter (N) (initialization value=0) is incremented.

Step #506 checks if a sensor SE6 disposed in the delivering section 2 detects the rearward end of a sheet, and when it is detected, step #507 turns on a timer F. The time $T_F$ set by the timer F delays the sheet refeeding for the next sheet, thereby refeeding the sheets into the copying apparatus 100A at adequate intervals. In this way the original intervals are restored.

When the time set by the timer F lapses in step #508 and the timer F flag is "1" in Step #508, step #510 turns on the motor $m_1$ and the clutch C2 to drive the web 33 and the roller 44, and resets the timer F flag to "0".

Step #511 compares the value (N) counted in step #505 with the value ($N_0$) sent from the copying apparatus, and when they are not equal to each other, the sequence advances to step #512.

Step #512 checks if the sensor SE1 disposed in the sheet discharging section 6 of the refeeding device 100B detects the rearward end of a sheet. When it is detected, the counter ($N_1$) is incremented in step #513, and step #514 compares the value ($N_1$) with the value ($N_0$) sent from the copying apparatus. When they are not equal to each other, the routine finishes. When they are found to be equal, it means that the set number of sheets have had copies on both sides. Therefore step #518 stops the operation of the refeeding device 100B after a time $T_G$ (set by a timer G) passes so as to enable the last double-face copied sheet to be fed out to the discharge tray 60. (steps #515, 516 and 517) At the same time the step #518 resets the refeeding flag to "0" to indicate that the sheet refeeding operation is not in progress.

When step #511 finds that the value (N) counted in step #505 is equal to the value ($N_0$) sent from the copying apparatus, it means that the set number of sheets having a one side copy have been all discharged. Then step #520 checks if the mark of the web 33 indicating the initial position thereof is detected. When the mark is detected, step #521 turns off the motor $m_1$ to stop the operation of the sheet holding section 3, and turns off the clutch C2 to stop the roller 44.

Figure 26:
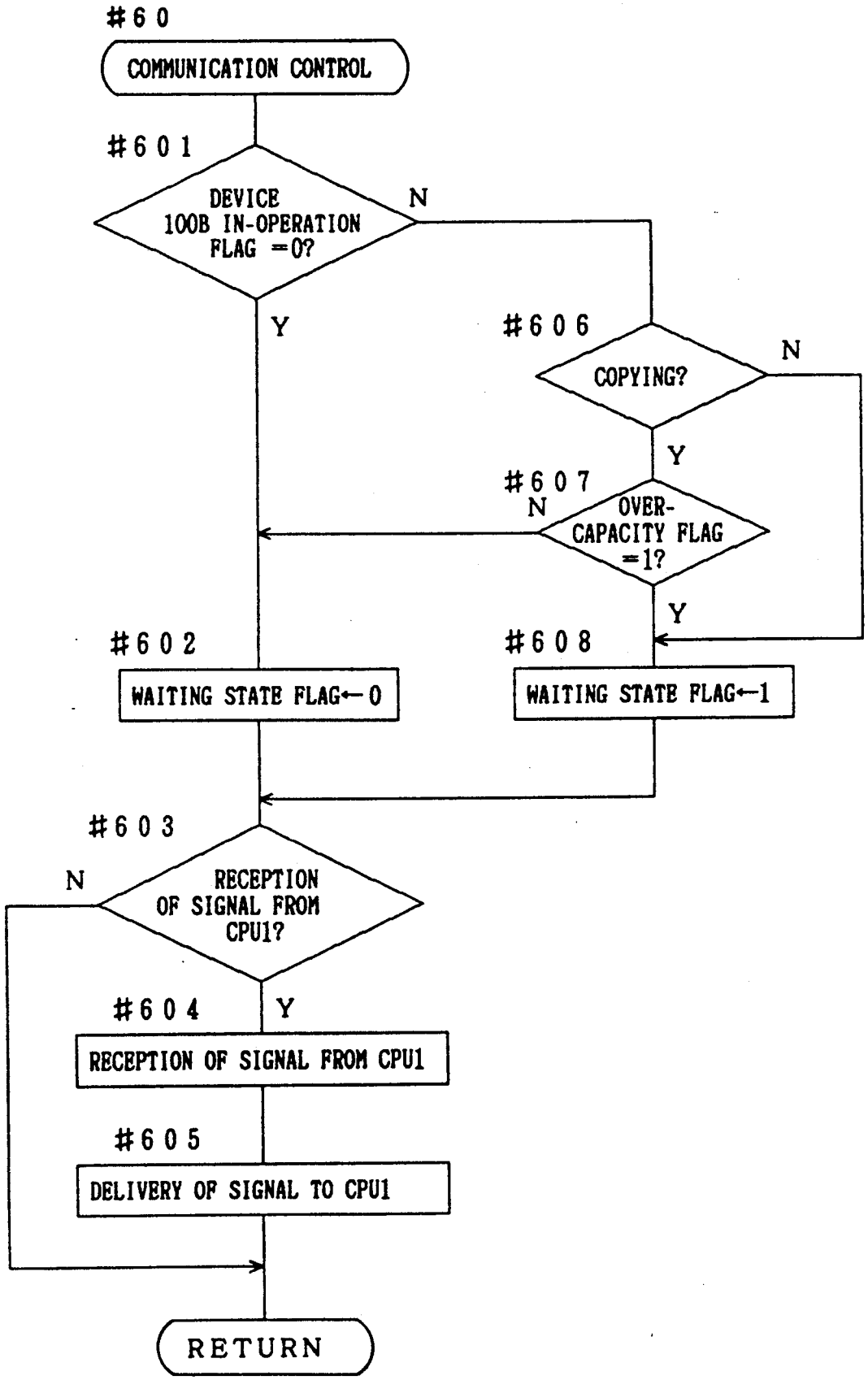
FIG. 26 is a flowchart showing another routine for executing communication control.

Referring to FIG. 26, a communication control routine (step #60) will be described:

Step #601 checks if the discharge flag, the composite flag, the accommodation flag and the refeeding flag, all of which indicate that the operation of the refeeding device 100B is in progress, are reset to "0". When all of them are reset, the sequence advances to step #602 which resets the waiting state flag to "0".

When at least one of the flags indicating the operation of the refeeding device 100B is set to "1", the sequence advances to step #606. Step #606 checks if the signal sent from the copying apparatus indicates that the copying is in progress. When it is found that the signal indicates the copying operation in progress, step #607 checks if the over-capacity flag output in step #418 is "1". When it is not "1", step #602 resets the waiting state flag to "0".

When step #606 finds that the copying operation is not in progress, or the over-capacity flag is set to "0", step #608 sets the waiting state flag to "1", and the sequence advances to step #603. Step #603 checks if there is a signal delivered by the CPU1, and when it is found that there is one, step #604 receives the signal, and step #605 sends a signal to the CPU1. Then the sequence returns to the main routine.

Figure 27:
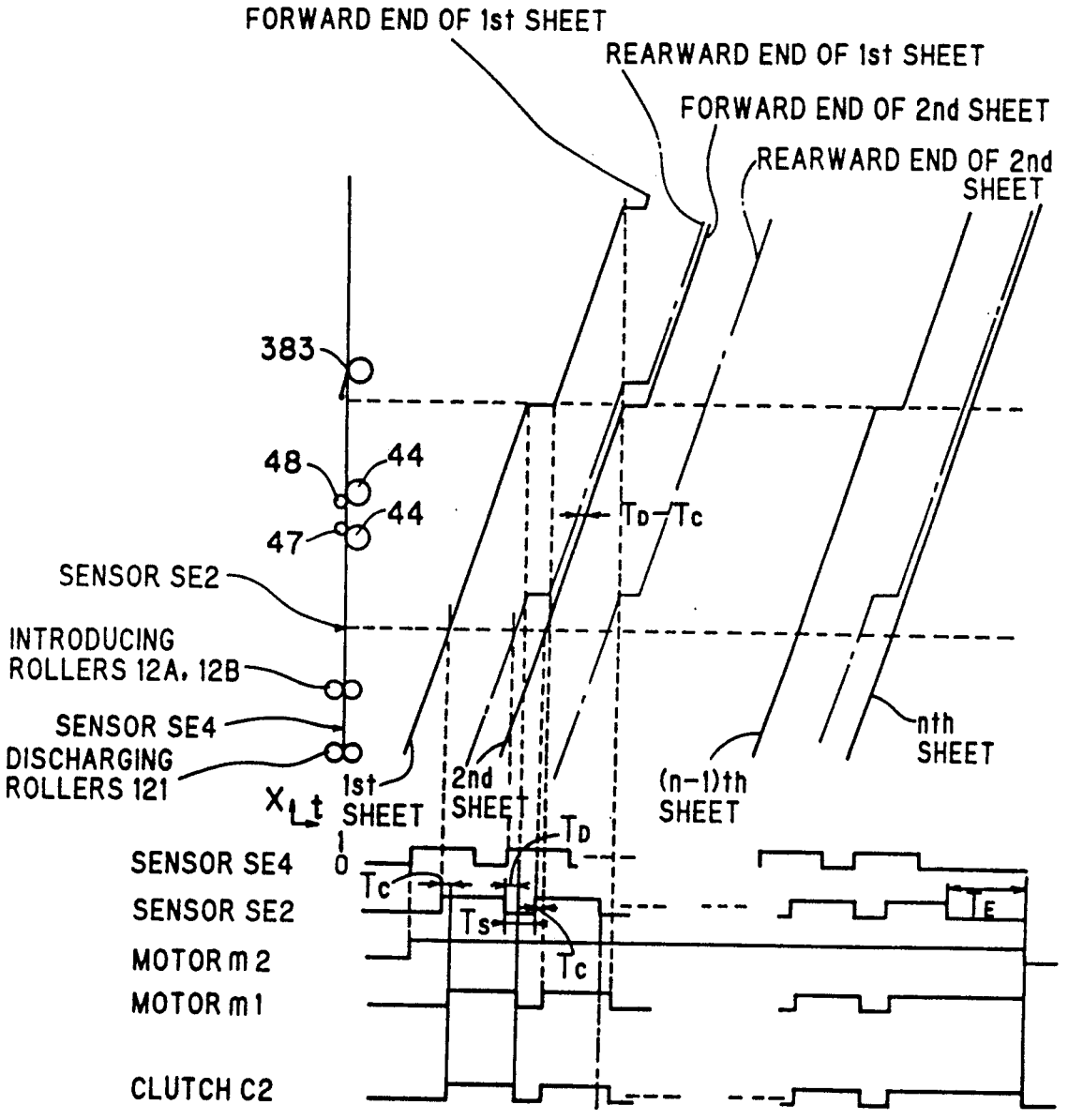
FIG. 27 is a timing chart on the mode (3)
Figure 28:
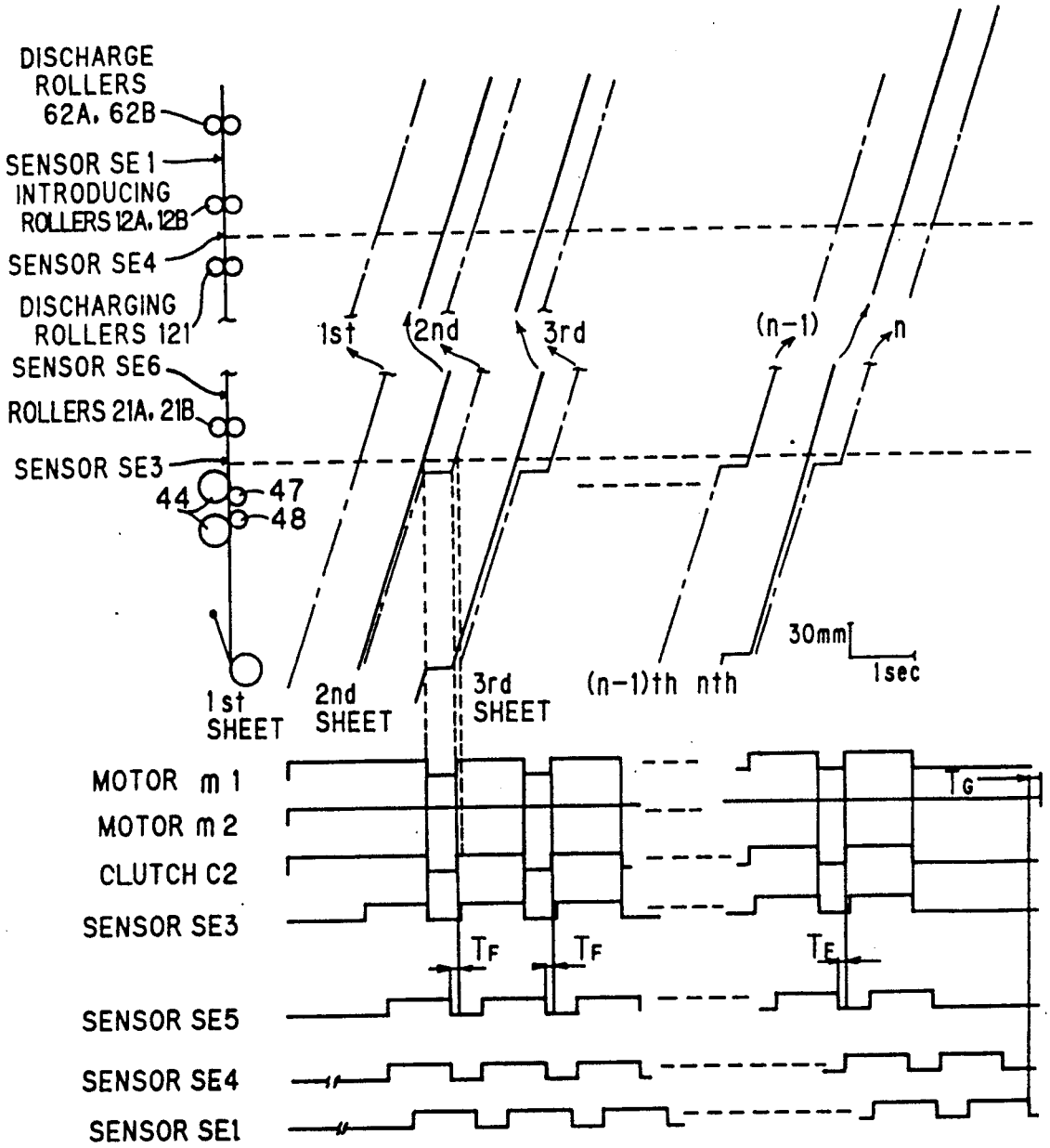
FIG. 28 is a timing chart on the mode (4)

FIGS. 27 and 28 are timing charts showing the movement of sheets following the foregoing flowcharts in the modes (3) and (4) and the operations of motors $m_1$, $m_2$, sensors, clutches, rollers, etc.

Referring to FIG. 27, a time $T_S$ is a period of time from the complete discharge of a preceding sheet out of the copying apparatus until the initiation of the discharge of a subsequent sheet. While the motor $m_1$ is not in operation, the sheet stays between the rollers 44, 47 and rollers 44, 48 for a time ($T_S-T_D+T_C$). After the sheets stay, the time interval between the preceding sheet and the subsequent sheet is expressed by:

$$T_S-(T_S-T_D+T_C)=T_D-T_C<T_S$$

As is evident from this relation, the sheets are wound around the winding shaft for accommodation at relatively short intervals. However, when they are unwound, the forward end and the rearward end of a sheet are reversed as shown in FIG. 28, and by controlling the on-timing of the motor $m_1$ by use of the timer F the sheet-to-sheet intervals are enlarged, thereby feeding the sheets to the copying apparatus at adequate intervals.

In the timing charts of FIGS. 27 and 28 the sheet feeding speed in the copying apparatus 100A is 180 mm/sec, a sheet-to-sheet interval $L_S$ therein is 90 mm, and the length $L_P$ of a sheet is 180 mm.

In the illustrated embodiment the sheets are wound in the double-face copy mode, but it is possible that the sheet is turned upside down in the discharging section and then wound around the winding shaft for accommodation.

What is claimed is:

1. A duplex copying apparatus comprising:

an input means for inputting the number of sheets to be copied;

an image forming means for successively forming an image on each of the number of sheets inputted by the input means;

a sheet refeeding means for successively accommodating the sheets having the image on a first side thereof formed by the image forming means, and successively refeeding the same, after the first image forming is finished, to the image forming means to form a second image on a second side thereof;

means for detecting a size of sheet to be accommodated by the sheet refeeding means;

means for determining, according to the detected size of sheet, the maximum number of sheets which the sheet refeeding means is capable of accommodating; and a control means for forbidding the copying operation when the inputted number of sheets is greater than the determined maximum number.

2. A duplex copying apparatus as defined in claim 1, wherein the sheet refeeding means comprises a first winding shaft, a second winding shaft and a web connected to the first and second winding shaft at each end thereof, wherein the web is wound around the first winding shaft with the sheets placed thereon so as to accommodate the sheets on the first winding shaft, and wherein the web is unwound from the first winding shaft and wound around the second winding shaft so as to feed the sheets on the web to the image forming means.

3. A duplex copying apparatus as defined in claim 2, wherein the web has a predetermined length and the number of sheets to be accommodated on the first winding shaft differs depending on the sheet sizes.

4. A duplex copying apparatus as defined in claim 2, wherein the sheet refeeding means comprises means for feeding the copied sheets to the web, and means for driving the feeding means at a speed satisfying the relation ($V1 < V2$), where V1 is a sheet feeding speed by the feeding means and V2 is a speed at which the web is wound around the first winding shaft.

5. A duplex copying apparatus as defined in claim 2, wherein the sheet refeeding means comprises means for feeding the sheets placed on the web to the image forming means, and means for driving the feeding means at a speed satisfying the relation ($V3 > V4$), where V3 is a sheet feeding speed by the feeding means and V4 is a speed at which the web is unwound from the first winding shaft.

6. A copying apparatus comprising:

an input means for inputting the number of sheets to be copied;

an image forming means for successively forming an image on each of the number of sheets inputted by the input means;

a sheet refeeding means for successively accommodating the sheets having a first image thereon formed by the image forming means, and successively refeeding the same, after the first image forming is finished, to the image forming means to form a second image thereon;

means for detecting a size of sheet to be accommodated by the sheet refeeding means; and means for determining, according to the detected size of sheet, the maximum number of sheets which the sheet refeeding means is capable of accommodating.

7. A duplex copying apparatus as defined in claim 6, further comprising a comparing means for comparing the inputted number and the determined maximum number, and a control means for controlling the image forming means according to a result of the comparison by the comparing means.

8. A duplex copying apparatus which includes means for successively forming a first original document image on a first side of each of a desired number of sheets, an intermediate accommodating means for successively accommodating the first side copied sheets, means for refeeding the first side copied sheets from the intermediate accommodating means to the image forming means so as to form a second original document image on a second side thereof, the duplex copying apparatus further comprising:

an input means for inputting the number of sheets to be copied;

means for detecting a size of sheet to be accommodated by the intermediate accommodating means;

means for determining, according to the detected size of sheet, the maximum number of sheets which the intermediate accommodating means is capable of accommodating; and a control means for forbidding the copying operation when the inputted number of sheets is greater than the determined maximum number.

9. A method for controlling a copying apparatus, the method including the steps of successively forming a first image on each of a desired number of sheets, of successively accommodating the first copied sheets in an intermediate accommodating means, of refeeding the first copied sheets from the intermediate accommodating means to the image forming means so as to form a second image thereon, the method further comprising the steps of:

inputting the number of sheets to be copied for the image forming process;

detecting a size of sheet to be accommodated by the intermediate accommodating means;

determining, according to the detected size of sheet, the maximum number of sheets which the intermediate accommodating means is capable of accommodating; and controlling to forbid the copying operation when the inputted number of sheets is greater than the determined maximum number.

10. A copying apparatus comprising:

a first framework structure having a first port and a second port;

an image forming means disposed in the first framework structure to form an image on a sheet;

a discharging means disposed in the first framework structure to discharge sheets having an image formed thereon by the image forming means through the first port out of the first framework structure;

a sheet receiving means disposed in the first framework structure for feeding sheets received from outside the first framework structure through the second port to the image forming means;

a second framework structure detachable to the first framework structure, having a third port located opposite to the first port of the first framework structure, and a fourth port located opposite to the second port thereof;

a sheet refeeding means disposed in the second framework structure, comprising a first winding means, a second winding means, a web extending on the first and second winding means, a first feeding means for feeding the sheets received at the third port to the web, a second feeding means for feeding the sheets from the web to the fourth port;

wherein the sheets fed by the first feeding means are placed on the web, the web being wound around the first winding means with the sheets thereon so as to accommodate the sheets on the first winding means; and wherein the web wound around the first winding means is unwound therefrom onto the second winding means so as to feed the sheets on the web through the fourth port into the second port.

11. A copying apparatus as defined in claim 10, wherein the sheet discharging speed U1 of the discharging means, the sheet feeding speed V1 of the first feeding means and the speed V2 at which the web is wound around the first winding means satisfy the following relation:

$$U1 < V1 < V2.$$

12. A copying apparatus as defined in claim 10, wherein the speed U2 at which the sheet receiving means receives the sheets, the sheet feeding speed V3 of the second feeding means and the speed V4 at which the web is wound around the second winding means satisfy the following relation:

$$V4<V3<U2.$$

13. A copying apparatus comprising:

a first framework structure having a first port and a second port both produced in one side thereof, and the first port being located above the second port;

an image forming means disposed in the first framework structure to form an image on a sheet;

a discharging means disposed in the first framework structure to discharge sheets having an image formed thereon by the image forming means through the first port out of the first framework structure;

a sheet receiving means disposed in the first framework structure for feeding sheets received from outside the first framework structure through the second port to the image forming means;

a second framework structure detachable to one side of the first framework structure, having a third port located opposite to the first port of the first framework structure, and a fourth port located opposite to the second port thereof;

a sheet refeeding means disposed in the second framework structure, comprising a first winding means, a second winding means, the second winding means located above the first winding means, a web extended on the first and second winding means, a first feeding means for feeding the sheets received at the third port to the web, a second feeding means for feeding the sheets from the web to the fourth port;

wherein the sheets fed by the first feeding means are placed on the web, the web being wound around the first winding means with the sheets thereon so as to accommodate the sheets on the first winding means; and wherein the web wound around the first winding means is unwound therefrom onto the second winding means so as to feed the sheets on the web through the fourth port into the second port.

14. A copying apparatus comprising:

an image forming means for forming a first image on each of the sheets successively fed;

a sheet refeeding means for successively accommodating the first copied sheets, and successively refeeding same, after the first image forming is finished, to the image forming means, to form a second image thereon, wherein the sheet refeeding means comprises a first winding means, a second winding means and a web extended on the first and second winding means, wherein the web is wound around the first winding means with the sheets placed thereon so as to accommodate the sheets on the first winding means, and wherein the web is unwound from the first winding means and wound around the second winding means so as to feed the sheets on the web to the image forming means;

means for detecting any abnormality occurring in winding the web around the first winding means; and a control means for stopping the image forming operation in response to the detection of abnormality occurring in winding the web around the first winding means.

15. An image forming apparatus comprising:

an input means for inputting a numeral;

an image forming means for forming images on sheets;

a sheet refeeding means for successively accommodating the sheets having a first image formed by the image forming means and successively refeeding the same to the image forming means to form a second image thereon;

a detecting means for detecting a size of sheet to be accommodated by the sheet refeeding means;

a determining means for determining, according to the detected size of sheet, the maximum number of sheets that are possible for the sheet refeeding means to accommodate;

a control means for enabling the image forming means to form the first and the second images on the sheets of number which equals to the inputted numeral when the determined maximum number is greater than the inputted numeral, and for forbidding the image forming means to form images on the inputted numeral of the sheets when the inputted numeral is greater than the determined maximum number.

16. A duplex copying apparatus comprising:

an input means for inputting the number of copies to be made;

a duplex copying means for producing duplex copies each of which has images formed on both sides thereof;

a sheet feeding means for feeding sheets to the duplex copying means;

a detecting means for detecting a size of the sheets to be fed to the duplex copying means;

a determining means for determining, according to the detected size of sheet, the maximum number of the duplex copies that are possible for the duplex copying means to produce; and a control means for enabling the duplex copying means to produce a plurality of duplex copies which equals the number inputted by the input means on condition that the inputted number is smaller than or equal to the maximum number determined by the determining means.

17. An image forming apparatus in which image forming operations are performed a plurality of times for each sheet, comprising:

an input means for inputting the number of sheets on which images are to be formed;

a sheet refeeding means for successively receiving the inputted number of sheets on which images were formed by image forming operation and for sending off the same sheets for further image formation;

a judging means for judging the maximum number of sheets which can be present at one time in the sheet refeeding means; and a control means for enabling the sheet refeeding means to operate on condition that the inputted number is smaller than or equal to the maximum number judged by the judging means.

18. A copying apparatus comprising:

an image forming means for forming a first image on each of sheets successively fed;

a sheet refeeding means for successively accommodating the sheets, and successively refeeding the same, after the first image forming is finished, to the image forming means, to form a second image thereon, wherein the sheet refeeding means comprises a first winding means, a second winding means and a web extended on the first and second winding means, wherein the web is wound around the first winding means with the sheets placed thereon so as to accommodate the sheets on the first winding means, and wherein the web is unwound from the first winding means and wound around the second winding means so as to feed the sheets on the web to the image forming means;

said web having an initial position mark indicative of an initial position from which said web is to be wound by said first winding means;

means for detecting the initial position mark; and a control means for stopping the feeding operation of the sheets by the sheet refeeding means in response to the detection of the initial position mark.

* * * * *

UNITED STATES PATENT AND TRADEMARK OFFICE

CERTIFICATE OF CORRECTION

PATENT NO. : 5,028,965

DATED : July 2, 1991

INVENTOR(S) : Keichi Kinoshita, et al.

It is certified that error appears in the above-identified patent and that said Letters Patent is hereby corrected as shown below:

At col. 12, line 61, before "sheet", delete "the".

At col. 13, line 18, change "$L_o$" to --$L_c$--.

At col. 13, line 22, change "$L_o$" to --$L_c$--.

At col. 13, line 24, change "$L_o$" to --$L_c$--.

At col. 13, line 29, change "$L_o$" to --$L_c$--.

At col. 13, line 30, change "$L_o$" to --$L_c$--.

At col. 13, line 39, change "$L_R$" to --$L_s$--.

At col. 13, line 44, change "$L_o$" to --$L_c$--.

At col. 13, line 45, change "$L_R$" to --$L_s$--.

At col. 14, line 57, change "K 21" to --K21--.

At col. 17, line 23, change "$L_o$" to --$L_c$--.

Signed and Sealed this

Tenth Day of November, 1992

*Attest:*

DOUGLAS B. COMER

*Attesting Officer*

*Acting Commissioner of Patents and Trademarks*